US011746435B2

(12) United States Patent
Banik et al.

(10) Patent No.: US 11,746,435 B2
(45) Date of Patent: *Sep. 5, 2023

(54) REMOVING BUBBLES FROM PLATING CELLS

(71) Applicant: LAM RESEARCH CORPORATION, Fremont, CA (US)

(72) Inventors: Stephen J. Banik, Portland, OR (US); Bryan L. Buckalew, Tualatin, OR (US); Gabriel Hay Graham, Portland, OR (US); Alfred Bostick, Tigard, OR (US); Sean Wilbur, Lake Oswego, OR (US); John Floyd Ostrowski, Lake Oswego, OR (US)

(73) Assignee: LAM RESEARCH CORPORATION, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/561,146

(22) Filed: Dec. 23, 2021

(65) Prior Publication Data

US 2022/0119977 A1 Apr. 21, 2022

Related U.S. Application Data

(63) Continuation of application No. 16/870,411, filed on May 8, 2020, now Pat. No. 11,214,887, which is a (Continued)

(51) Int. Cl.
*C25D 17/00* (2006.01)
*C25D 21/04* (2006.01)
(Continued)

(52) U.S. Cl.
CPC ..... *C25D 17/001* (2013.01); *C25D 5/08* (2013.01); *C25D 21/04* (2013.01); *C25D 21/14* (2013.01)

(58) Field of Classification Search
CPC ..... C25D 17/001; C25D 5/08; C25D 21/04; C25D 21/14
See application file for complete search history.

(56) References Cited

U.S. PATENT DOCUMENTS 6,964,792 B1 11/2005 Mayer et al.
7,045,040 B2 5/2006 Basol
(Continued)

OTHER PUBLICATIONS

International Search Report and Written Opinion for PCT Application No. PCT/US2019/029568 dated Aug. 6, 2019.
U.S. Appl. No. 62/548,116, filed Aug. 21, 2017.

*Primary Examiner* — Zulmariam Mendez

(57) ABSTRACT

An electroplating apparatus includes an electrode at the bottom of a chamber, an ionically resistive element with through holes arranged horizontally at the top of the chamber, with a membrane in the middle. One or more panels extend vertically and parallelly from the membrane to the element and extend linearly across the chamber, forming a plurality of regions between the membrane and the element. A substrate with a protuberance extending along a chord of the substrate and contacting a top surface of the element is arranged above a first region. An electrolyte flowed between the substrate and the element descends into the first region via the through holes on a first side of the protuberance and ascends from the first region via the through holes on a second side of the protuberance, forcing air bubbles out from a portion of the element associated with the first region.

39 Claims, 23 Drawing Sheets

Related U.S. Application Data continuation of application No. 15/968,192, filed on May 1, 2018, now Pat. No. 10,655,240.

(51) Int. Cl.
*C25D 21/14* (2006.01)
*C25D 5/08* (2006.01)

(56) References Cited

U.S. PATENT DOCUMENTS

| | | | |
|---|---|---|---|
| 9,624,592 | B2 | 4/2017 | Abraham et al. |
| 9,834,852 | B2 | 12/2017 | Mayer et al. |
| 2011/0226613 | A1 | 9/2011 | Rash et al. |
| 2013/0313123 | A1 | 11/2013 | Abraham et al. |
| 2016/0215408 | A1 | 7/2016 | Kagajwala et al. |

REMOVING BUBBLES FROM PLATING CELLS

CROSS-REFERENCE TO RELATED APPLICATIONS

The present disclosure is a continuation of U.S. patent application Ser. No. 16/870,411 (now U.S. Pat. No. 11,214,887), filed on May 8, 2020 which is a continuation of U.S. patent application Ser. No. 15/968,192 (now U.S. Pat. No. 10,655,240), filed on May 1, 2018. The entire disclosures of the applications referenced above are incorporated herein by reference.

FIELD

The present disclosure relates generally to electroplating substrates and more specifically to removing bubbles from plating cells used for electroplating substrates.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Electrochemical deposition (ECD), also called plating or electroplating, is used to deposit metals onto substrates. For example, ECD is used to deposit metals on interconnect structures in an IC package. Examples of the interconnect structures include bumps, pillars, through silicon vias (TSVs), and redistribution layers (RDLs). ECD is also used in multichip packaging and interconnection processes generally called wafer level packaging (WLP).

SUMMARY

An electroplating apparatus comprises a chamber including an electrode arranged horizontally along a bottom portion of the chamber and an ionically resistive element with through holes arranged horizontally along a top portion of the chamber. The electroplating apparatus further comprises a membrane supported by a frame arranged between the electrode and the ionically resistive element. The electroplating apparatus further comprises one or more panels extending vertically and parallelly from the membrane to the ionically resistive element and extending linearly across the chamber, forming a plurality of regions between the membrane and the ionically resistive element. The electroplating apparatus further comprises a substrate holder arranged above the ionically resistive element to hold a first substrate with a treatable surface parallel to and facing the ionically resistive element. The electroplating apparatus further comprises a seal arranged between peripheries of the ionically resistive element and the substrate holder to prevent leakage of an electrolyte flowed laterally through a manifold between the treatable surface of the first substrate and a top surface of the ionically resistive element during electroplating, portions of the electrolyte descending from the manifold into the plurality of regions and ascending from the plurality of regions into the manifold via the through holes, forming air bubbles under the ionically resistive element and in a plurality of the through holes. The electroplating apparatus further comprises a controller configured to place, in the substrate holder, a second substrate with a protuberance extending along a chord of the second substrate, the protuberance contacting the top surface of the ionically resistive element above a first region of the plurality of regions and arranged across the top surface of the ionically resistive element along one of the panels forming the first region. The controller is further configured to flow the electrolyte through the manifold, the electrolyte descending from the manifold into the first region via the through holes on a first side of the protuberance and ascending from the first region into the manifold via the through holes on a second side of the protuberance, forcing the air bubbles out from a portion of the ionically resistive element associated with the first region.

In another feature, the protuberance is integrated into the second substrate.

In another feature, the protuberance is a gasket.

In other features, the controller is configured to keep the protuberance in contact with the top surface of the ionically resistive element above the first region for a first predetermined time. The controller is further configured to rotate the second substrate after the first predetermined time and position the protuberance in contact with the top surface of the ionically resistive element above a second region of the plurality of regions along one of the panels forming the second region. The controller is further configured to keep the protuberance in contact with the top surface of the ionically resistive element above the second region for a second predetermined time. The electrolyte descending from the manifold into the second region via the through holes on the first side of the protuberance and ascending from the second region into the manifold via the through holes on the second side of the protuberance forces the air bubbles out from a portion of the ionically resistive element associated with the second region.

In another feature, the protuberance is arranged at a center of the first region.

In another feature, the protuberance extends linearly along the chord of the second substrate.

In another feature, the protuberance extends nonlinearly along the chord of the second substrate.

In another feature, the protuberance includes one or more gaps along a length of the protuberance.

In other features, the second substrate includes a second protuberance along a second chord, the second protuberance contacting the top surface of the ionically resistive element above a second region of the plurality of regions and arranged across the top surface of the ionically resistive element along one of the panels forming the second region.

In other features, the electrolyte descending from the manifold into the second region via the through holes on a first side of the second protuberance and ascending from the second region into the manifold via the through holes on a second side of the second protuberance forces the air bubbles out from a portion of the ionically resistive element associated with the second region.

In another feature, the protuberance and the second protuberance are parallel to each other.

In another feature, the protuberance and the second protuberance are not parallel to each other.

In another feature, at least one of the protuberance and the second protuberance includes one or more gaps along respective lengths.

In another feature, the gaps of the protuberance and the second protuberance are aligned with each other.

In another feature, the gaps of the protuberance and the second protuberance are not aligned with each other.

In other features, the controller is configured to place, in the substrate holder, a third substrate with a second protuberance extending along a chord of the third substrate, the second protuberance contacting the top surface of the ionically resistive element above a second region of the plurality of regions and arranged across the top surface of the ionically resistive element along one of the panels forming the second region. The electrolyte descending from the manifold into the second region via the through holes on a first side of the second protuberance and ascending from the second region into the manifold via the through holes on a second side of the second protuberance forces the air bubbles out from a portion of the ionically resistive element associated with the second region.

In another feature, the protuberance and the second protuberance are integrated into the respective substrates.

In another feature, each of the protuberance and the second protuberance is a gasket.

In other features, the controller is configured to keep the second protuberance in contact with the top surface of the ionically resistive element above the second region for a first predetermined time. The controller is further configured to rotate the third substrate after the first predetermined time and position the second protuberance in contact with the top surface of the ionically resistive element above a third region of the plurality of regions along one of the panels forming the third region. The controller is further configured to keep the second protuberance in contact with the top surface of the ionically resistive element above the third region for a second predetermined time. The electrolyte descending from the manifold into the third region via the through holes on the first side of the second protuberance and ascending from the third region into the manifold via the through holes on the second side of the second protuberance forces the air bubbles out from a portion of the ionically resistive element associated with the third region.

In another feature, at least one of the protuberance and the second protuberance is arranged at a center of the respective region.

In another feature, at least one of the protuberance and the second protuberance extends linearly along the chord of the respective substrate.

In another feature, at least one of the protuberance and the second protuberance extends nonlinearly along the chord of the respective substrate.

In another feature, at least one of the protuberance and the second protuberance includes one or more gaps along respective lengths.

In another feature, the gaps of the protuberance and the second protuberance are aligned with each other.

In another feature, the gaps of the protuberance and the second protuberance are not aligned with each other.

In other features, the third substrate includes a third protuberance along a second chord of the third substrate, the third protuberance contacting the top surface of the ionically resistive element above a third region of the plurality of regions and arranged across the top surface of the ionically resistive element along one of the panels forming the third region.

In other features, the electrolyte descending from the manifold into the third region via the through holes on a first side of the third protuberance and ascending from the third region into the manifold via the through holes on a second side of the third protuberance forces the air bubbles out from a portion of the ionically resistive element associated with the third region.

In another feature, at least two of the protuberance, the second protuberance, and the third protuberance are parallel to each other.

In another feature, at least two of the protuberance, the second protuberance, and the third protuberance are not parallel to each other.

In another feature, at least one of the protuberance, the second protuberance, and the third protuberance includes one or more gaps along respective lengths.

In another feature, the gaps of at least two of the protuberance, the second protuberance, and the third protuberance are aligned with each other.

In another feature, the gaps of at least two of the protuberance, the second protuberance, and the third protuberance are not aligned with each other.

In other features, the seal pushes against the substrate holder due to the flow of the electrolyte in the manifold and allows the electrolyte in the manifold to force the air bubbles out from under and in the through holes of the ionically resistive element.

In another feature, the membrane focuses the flow of the electrolyte via the through holes.

In another feature, the ionically resistive element operates as a uniform current source in proximity of the first substrate.

In another feature, at least a plurality of the through holes has the same dimension and density and is perpendicular relative to a plane along which the first substrate lies.

In another feature, at least a plurality of the through holes has different dimensions and densities and is oblique relative to a plane along which the first substrate lies.

In still other features, a method for an electroplating apparatus comprises arranging an electrode horizontally along a bottom portion of a chamber, arranging an ionically resistive element with through holes horizontally along a top portion of the chamber, and arranging a membrane supported by a frame between the electrode and the ionically resistive element. The method further comprises arranging one or more panels extending vertically and parallelly from the membrane to the ionically resistive element and extending linearly across the chamber, forming a plurality of regions between the membrane and the ionically resistive element. The method further comprises arranging a substrate holder above the ionically resistive element to hold a first substrate with a treatable surface parallel to and facing the ionically resistive element. The method further comprises arranging a seal arranged between peripheries of the ionically resistive element and the substrate holder to prevent leakage of an electrolyte flowed laterally through a manifold between the treatable surface of the first substrate and a top surface of the ionically resistive element during electroplating, portions of the electrolyte descending from the manifold into the plurality of regions and ascending from the plurality of regions into the manifold via the through holes, forming air bubbles under the ionically resistive element and in a plurality of the through holes. The method further comprises placing, in the substrate holder, a second substrate with a protuberance extending along a chord of the second substrate, the protuberance contacting the top surface of the ionically resistive element above a first region of the plurality of regions and arranged across the top surface of the ionically resistive element along one of the panels forming the first region. The method further comprises flowing the electrolyte through the manifold, the electrolyte descending from the manifold into the first region via the through holes on a first side of the protuberance and ascending from the first region into the manifold via the through holes on a second side of the protuberance, forcing the air bubbles out from a portion of the ionically resistive element associated with the first region.

In another feature, the method further comprises integrating the protuberance into the second substrate.

In another feature, the method further comprises arranging a gasket on the second substrate to form the protuberance.

In other features, the method further comprises keeping the protuberance in contact with the top surface of the ionically resistive element above the first region for a first predetermined time. The method further comprises rotating the second substrate after the first predetermined time and position the protuberance in contact with the top surface of the ionically resistive element above a second region of the plurality of regions along one of the panels forming the second region. The method further comprises keeping the protuberance in contact with the top surface of the ionically resistive element above the second region for a second predetermined time. The method further comprises forcing the air bubbles out from a portion of the ionically resistive element associated with the second region, with the electrolyte descending from the manifold into the second region via the through holes on the first side of the protuberance and ascending from the second region into the manifold via the through holes on the second side of the protuberance.

In another feature, the method further comprises arranging the protuberance at a center of the first region.

In another feature, the method further comprises extending the protuberance linearly along the chord of the second substrate.

In another feature, the method further comprises extending the protuberance nonlinearly along the chord of the second substrate.

In another feature, the method further comprises arranging one or more gaps along a length of the protuberance.

In other features, the method further comprises arranging a second protuberance along a second chord of the second substrate. The method further comprises arranging the second protuberance to contact the top surface of the ionically resistive element above a second region of the plurality of regions and across the top surface of the ionically resistive element along one of the panels forming the second region.

In other features, the method further comprises forcing the air bubbles out from a portion of the ionically resistive element associated with the second region, with the electrolyte descending from the manifold into the second region via the through holes on a first side of the second protuberance and ascending from the second region into the manifold via the through holes on a second side of the second protuberance.

In another feature, the method further comprises arranging the protuberance and the second protuberance parallel to each other.

In another feature, the method further comprises arranging the protuberance and the second protuberance not parallel to each other.

In another feature, the method further comprises arranging one or more gaps in at least one of the protuberance and the second protuberance along respective lengths.

In another feature, the method further comprises aligning the gaps of the protuberance and the second protuberance with each other.

In another feature, the method further comprises not aligning the gaps of the protuberance and the second protuberance with each other.

In other features, the method further comprises placing, in the substrate holder, a third substrate with a second protuberance extending along a chord of the third substrate, the second protuberance contacting the top surface of the ionically resistive element above a second region of the plurality of regions and arranged across the top surface of the ionically resistive element along one of the panels forming the second region. The method further comprises forcing the air bubbles out from a portion of the ionically resistive element associated with the second region, with the electrolyte descending from the manifold into the second region via the through holes on a first side of the second protuberance and ascending from the second region into the manifold via the through holes on a second side of the second protuberance.

In another feature, the method further comprises integrating the protuberance and the second protuberance into the respective substrates.

In another feature, the method further comprises forming each of the protuberance and the second protuberance using a gasket.

In other features, the method further comprises keeping the second protuberance in contact with the top surface of the ionically resistive element above the second region for a first predetermined time. The method further comprises rotating the third substrate after the first predetermined time and position the second protuberance in contact with the top surface of the ionically resistive element above a third region of the plurality of regions along one of the panels forming the third region. The method further comprises keeping the second protuberance in contact with the top surface of the ionically resistive element above the third region for a second predetermined time. The method further comprises forcing the air bubbles out from a portion of the ionically resistive element associated with the third region, with the electrolyte descending from the manifold into the third region via the through holes on the first side of the second protuberance and ascending from the third region into the manifold via the through holes on the second side of the second protuberance.

In another feature, the method further comprises arranging at least one of the protuberance and the second protuberance at a center of the respective region.

In another feature, the method further comprises extending at least one of the protuberance and the second protuberance linearly along the chord of the respective substrate.

In another feature, the method further comprises extending at least one of the protuberance and the second protuberance nonlinearly along the chord of the respective substrate.

In another feature, the method further comprises forming one or more gaps in at least one of the protuberance and the second protuberance along respective lengths.

In another feature, the method further comprises aligning the gaps of the protuberance and the second protuberance with each other.

In another feature, the method further comprises not aligning the gaps of the protuberance and the second protuberance with each other.

In other features, the method further comprises forming a third protuberance along a second chord of the third substrate. The method further comprises arranging the third protuberance to contact the top surface of the ionically resistive element above a third region of the plurality of regions and across the top surface of the ionically resistive element along one of the panels forming the third region.

In other features, the method further comprises forcing the air bubbles out from a portion of the ionically resistive element associated with the third region, with the electrolyte descending from the manifold into the third region via the through holes on a first side of the third protuberance and ascending from the third region into the manifold via the through holes on a second side of the third protuberance.

In another feature, the method further comprises arranging at least two of the protuberance, the second protuberance, and the third protuberance parallel to each other.

In another feature, the method further comprises arranging at least two of the protuberance, the second protuberance, and the third protuberance not parallel to each other.

In another feature, the method further comprises forming one or more gaps in at least one of the protuberance, the second protuberance, and the third protuberance along respective lengths.

In another feature, the method further comprises aligning the gaps of at least two of the protuberance, the second protuberance, and the third protuberance with each other.

In another feature, the method further comprises not aligning the gaps of at least two of the protuberance, the second protuberance, and the third protuberance with each other.

In other features, the method further comprises arranging the seal to push against the substrate holder due to the flow of the electrolyte in the manifold, and to allow the electrolyte in the manifold to force the air bubbles out from under and in the through holes of the ionically resistive element.

In another feature, the method further comprises focusing the flow of the electrolyte via the through holes using the membrane.

In another feature, the method further comprises operating the ionically resistive element as a uniform current source in proximity of the first substrate.

In other features, the method further comprises providing at least a plurality of the through holes with the same dimension and density, and arranging at least a plurality of the through holes perpendicularly relative to a plane along which the first substrate lies.

In other features, the method further comprises providing at least a plurality of the through holes has different dimensions and densities, and arranging at least a plurality of the through holes obliquely relative to a plane along which the first substrate lies.

One or more features described above and below, including the features recited in the claims, although described and recited separately, can be combined.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Air bubbles can form in an electroplating cell during electroplating. The air bubbles can adversely affect the electroplating process. The present disclosure relates to various substrate designs that can be used in place of the substrates being electroplated to extinguish the air bubbles. One or more of these substrates, which can be called dummy substrates or flow focusing substrates, can be used to remove the air bubbles after electroplating a substrate and before electroplating a next substrate. These and other aspects of the present disclosure are explained below in detail.

The present disclosure is organized as follows. Initially, an electroplating cell used for electroplating substrates is described with references to FIGS. 1A-3. Subsequently, formation of air bubbles in the electroplating cell is explained and removal of the air bubbles using various substrate designs is described in detail with reference to FIGS. 4-9E. Thereafter, a tool for electroplating substrates that uses one or more of the specially designed substrates to automatically remove the air bubbles is described with reference to FIG. 10. Thereafter, performances of the manual and automatic processes of removing air bubbles are compared with reference to FIGS. 11A-11C, which is followed by a summary of the present disclosure. Thereafter, a method for removing the air bubbles in the electroplating cell described with reference to FIG. 12.

Figure 1A:
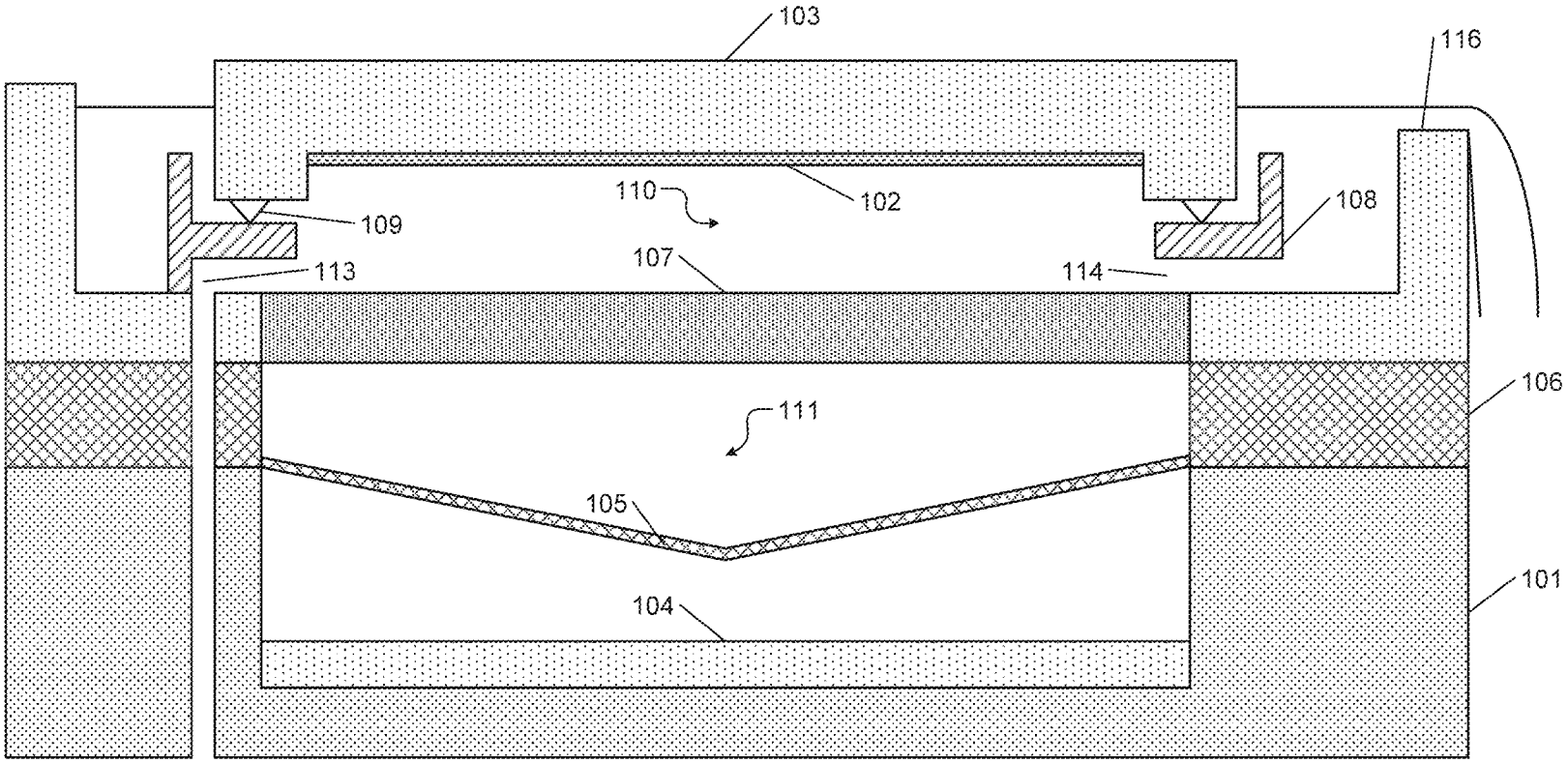
FIGS. 1A-1C show a simplified cross-sectional view of an electroplating cell.
Figure 1B:
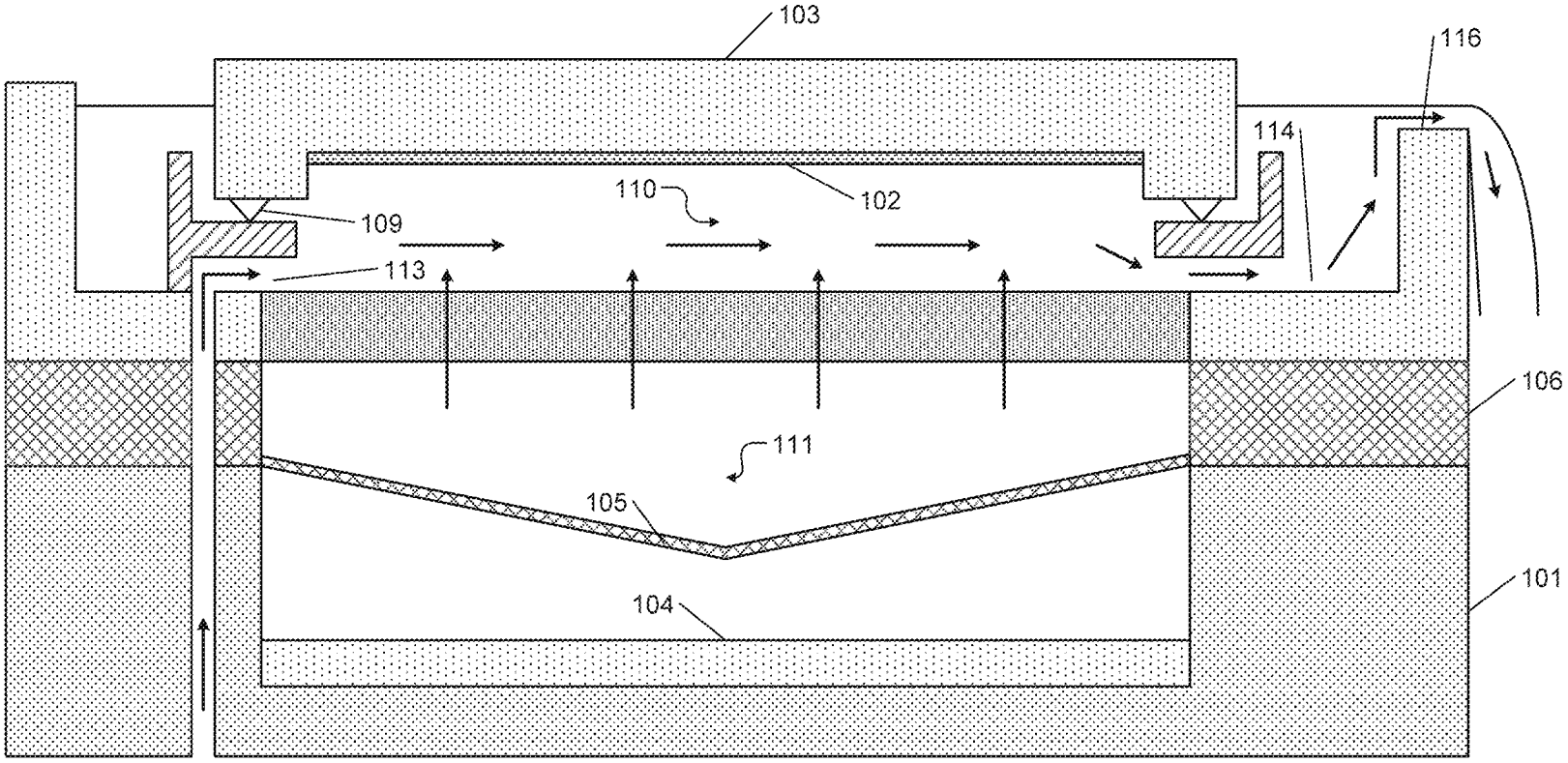
Figure 1C:
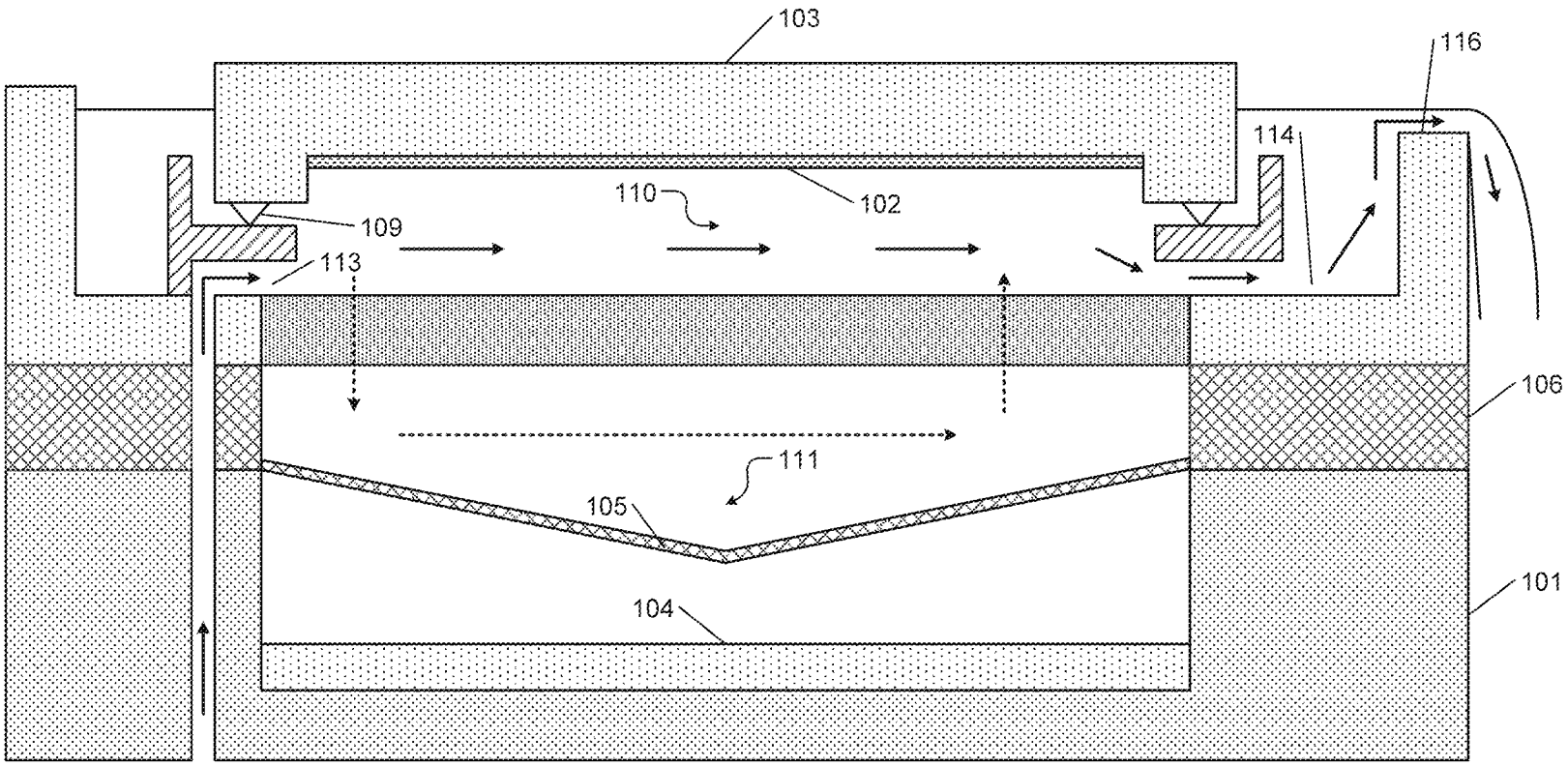

FIGS. 1A-1C show simplified cross-sectional views of an electroplating apparatus according to the present disclosure. FIG. 1A shows a simplified cross-sectional view of an electroplating cell. FIG. 1B includes arrows indicating the flow of an electrolyte through the electroplating cell during electroplating. FIG. 1C illustrates deviations in the flow of the electrolyte that can occur during electroplating.

FIG. 1A shows an electroplating cell 101 with a substrate 102 positioned in a substrate holder 103. The substrate holder 103 is also called a cup and supports the substrate 102 at its periphery. A surface of the substrate 102 to be electroplated faces downwards and is exposed to the flow of the electrolyte during electroplating. An anode 104 is positioned near the bottom of the electroplating cell 101. The substrate 102 acts as a cathode when power is supplied to the electroplating cell 101 during electroplating.

The anode 104 is separated from the substrate 102 by a membrane 105, which is supported by a membrane frame 106. The anode 104 and the membrane 105 are separated from the substrate 102 by an ionically resistive element 107. The ionically resistive element 107 is positioned above the membrane 105 and the membrane frame 106 near the top of the electroplating cell 101. The membrane 105 in the membrane frame 106 is positioned between the anode 104 and the ionically resistive element 107.

Figure 2A:
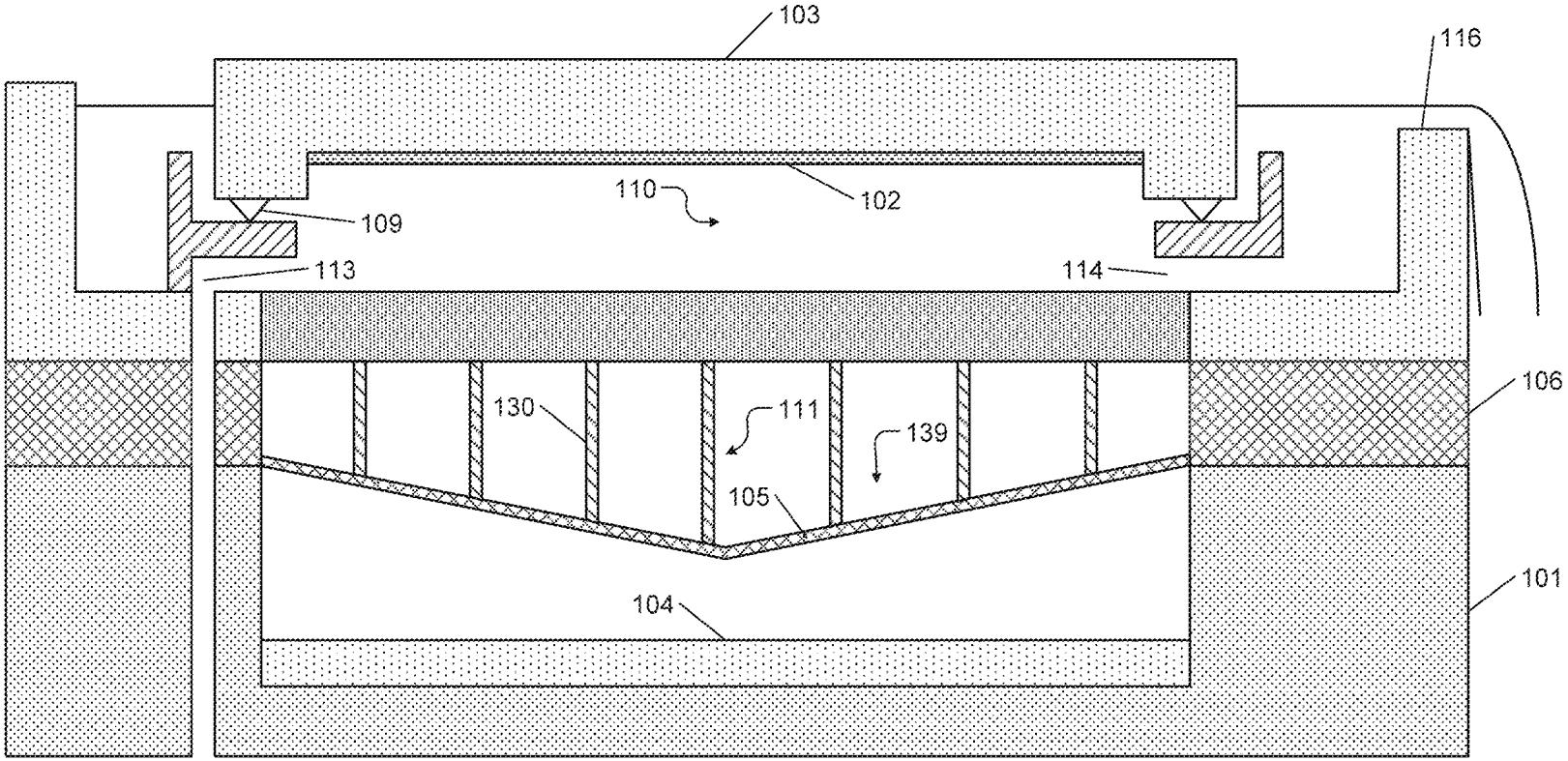
FIG. 2A shows a simplified cross-sectional view of the electroplating cell including a plurality of baffles.
Figure 2B:
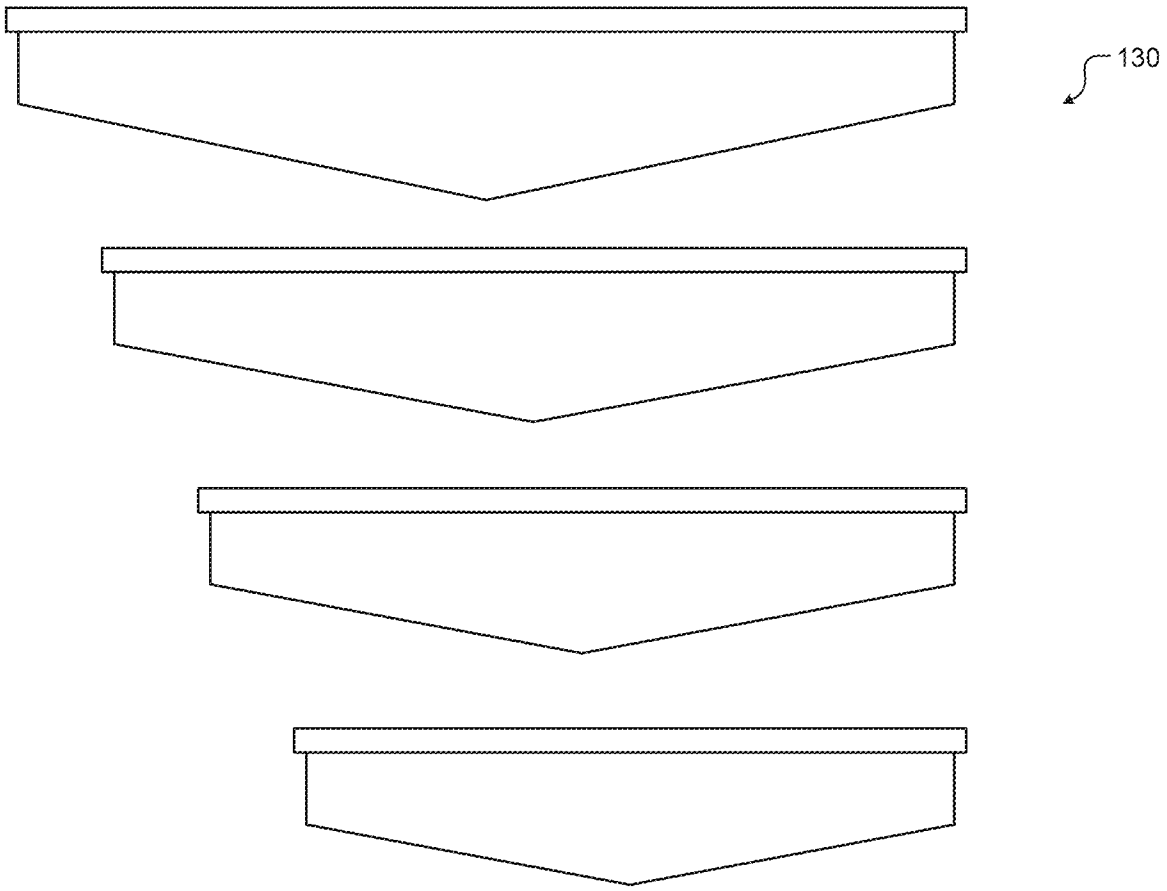
FIG. 2B shows examples of the baffles.
Figure 2C:
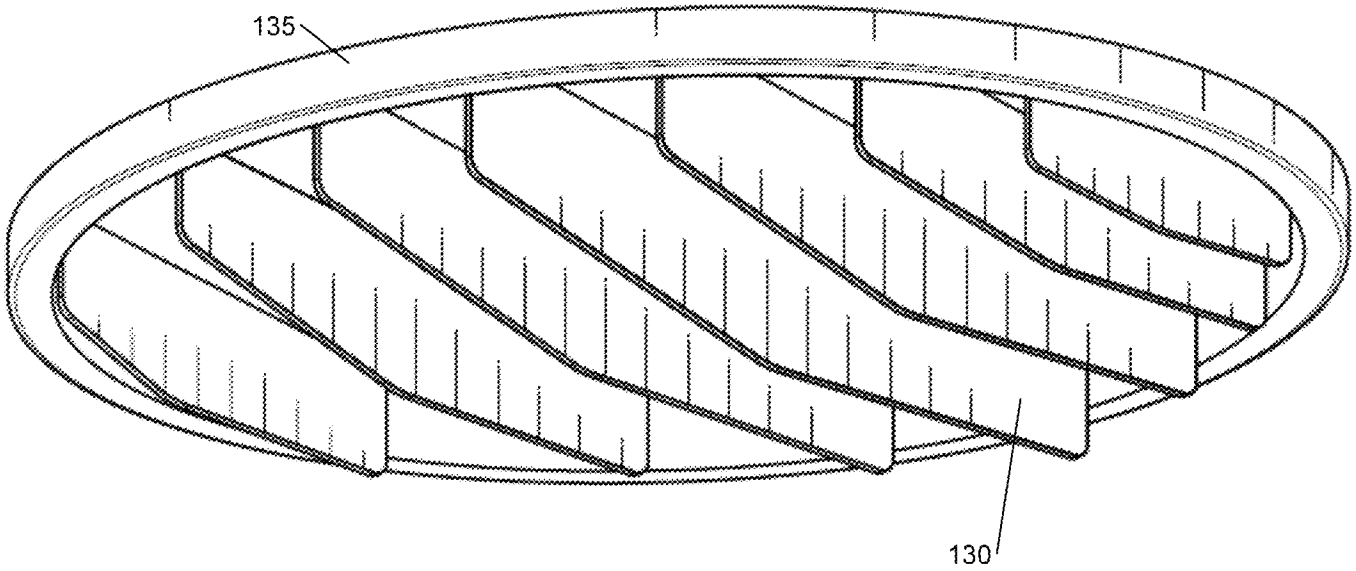
FIGS. 2C and 2D show different views of a back side insert along with the baffles.
Figure 2D:
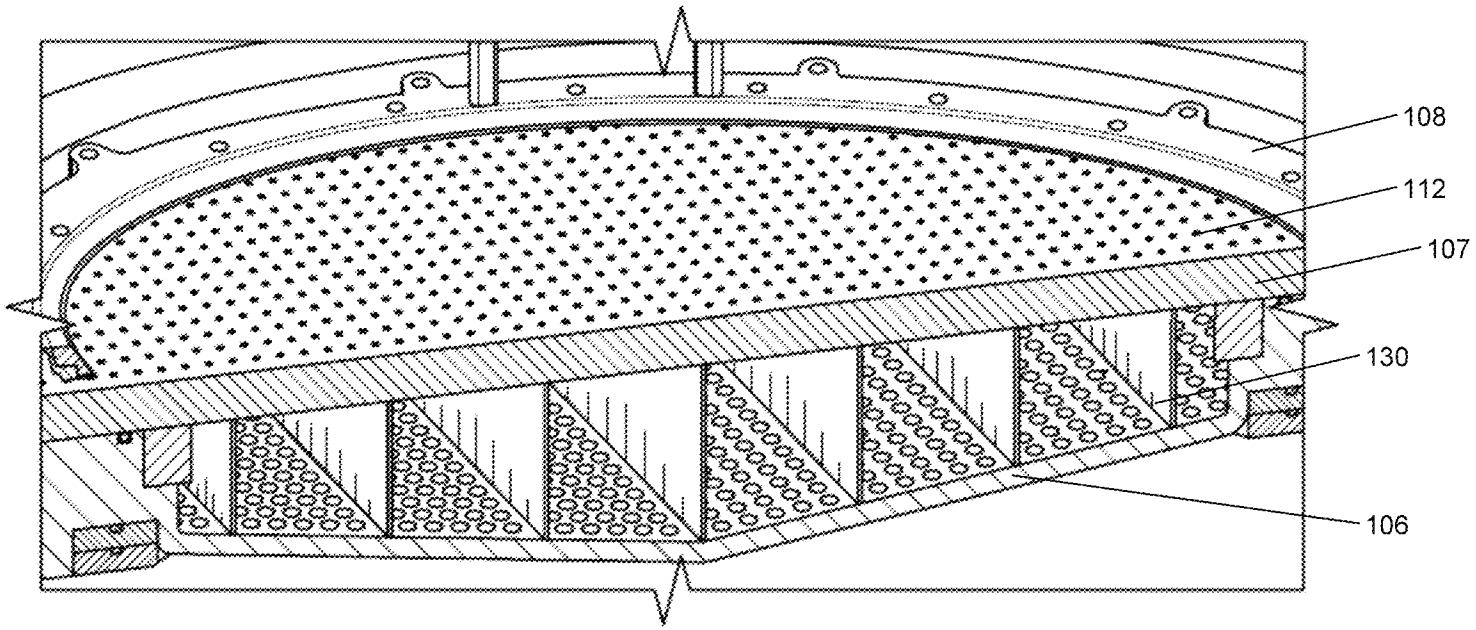

The ionically resistive element 107 includes openings in the form of through holes 112 (shown in FIG. 2D). The through holes 112 allow the electrolyte to travel through the ionically resistive element 107 to impinge upon the substrate 102 during electroplating. Further details about the through holes 112 are described below.

A front side insert 108 is positioned above the ionically resistive element 107 near the periphery (i.e., perimeter or rim) of the substrate 102 and the substrate holder 103. The front side insert 108 may be ring-shaped (see FIGS. 8A and 8B).

A dynamic seal 109 is positioned between the front side insert 108 and the bottom of the substrate holder 103 to prevent the electrolyte from leaking during electroplating. The dynamic seal 109 is shown and described in greater detail with reference to FIGS. 8A and 8B.

A cross flow manifold 110 is formed above the ionically resistive element 107 and below the substrate 102. The height of the cross flow manifold 110 is the distance between the substrate 102 and the plane of the ionically resistive element 107. For example, the height of the cross flow manifold 110 may be between about 1 mm-4 mm or between about 0.5 mm-15 mm. The cross flow manifold 110 is defined on its sides by the front side insert 108, which contains the cross flowing electrolyte within the cross flow manifold 110. A side inlet 113 to the cross flow manifold 110 is azimuthally opposite to a side outlet 114 to the cross flow manifold 110. The side inlet 113 and the side outlet 114 may be formed, at least partially, by the front side insert 108.

FIG. 1B shows a travel path of the electrolyte using arrows. The electrolyte travels through the side inlet 113, into the cross flow manifold 110, and exits through the side outlet 114. In addition, the electrolyte may travel through one or more inlets (not shown) into a second manifold 111 formed between the ionically resistive element 107 and the membrane 105, through the openings in the ionically resistive element 107 (through holes 112) into the cross flow manifold 110, and may exit through the side outlet 114. After passing through the side outlet 114, the electrolyte spills over a weir wall 116. The electrolyte may be recovered and recycled.

During electroplating, the ionically resistive element 107 approximates a uniform current source in the proximity of the substrate (cathode) 102. The ionically resistive element 107 can be called a high resistance virtual anode (HRVA) or a channeled ionically resistive element (CIRP). The ionically resistive element 107 is arranged in close proximity to the substrate 102. During electroplating, a nearly constant current is sourced from across an upper plane of the ionically resistive element 107.

The ionically resistive element 107 includes micro size through holes 112 (e.g., less than 0.04"). The through holes 112 are spatially and ionically isolated from each other. The through holes 112 generally do not form interconnecting channels within the body of the ionically resistive element 107 and are called non-communicating through holes 112. The through holes 112 generally extend perpendicular to the plated surface of the substrate 102. In some embodiments, the through holes 112 may extend at an angle relative to the plane of the substrate 102. The through holes 112 are generally parallel to one another. The through holes 112 may be arranged in a square array, in an offset spiral pattern, or in any other suitable pattern. The through holes 112 restructure the ionic current flow and the fluid flow and direct the path of both the ionic current and the fluid flow towards the plating surface of the substrate 102.

In one example, the ionically resistive element 107 is a disc made of a solid non-porous dielectric material that is ionically and electrically resistive. The material is also chemically stable in the presence of the electrolyte used. In some cases, the ionically resistive element 107 is made of a ceramic material. For example, the ceramic material may include aluminum oxide, stannic oxide, titanium oxide, or mixtures of metal oxides. In some cases, the ionically resistive element 107 is made of a plastic material. For example, the plastic material may include polyethylene, polypropylene, polyvinylidene difluoride (PVDF), polytetrafluoroethylene, polysulfone, polyvinyl chloride (PVC), or polycarbonate. The top and bottom surfaces of the ionically resistive element 107 may be flat or substantially flat. The ionically resistive element 107 may have between about 6,000-12,000 non-communicating through holes 112.

The ionically resistive element 107 is substantially coextensive with the substrate 102. For example, the ionically resistive element 107 has a diameter of about 300 mm when used with a 300 mm substrate. The ionically resistive element 107 resides in close proximity to the substrate 102, which is generally parallel to a top surface of the ionically resistive element 107. For example, the ionically resistive element 107 resides immediately below the substrate 102 in a substrate-facing-down electroplating apparatus. Preferably, the plating surface of the substrate 102 resides within about 10 mm, more preferably within about 5 mm of the top surface of the ionically resistive element 107.

The ionic and flow resistance of the ionically resistive element 107 depends on factors including the thickness of the ionically resistive element 107, the overall porosity (fraction of area available for flow through the plate), and the size/diameter of the through holes 112. Plates of lower porosities have higher impinging flow velocities and ionic resistances. Plates with through holes 112 having a relatively smaller diameter (and therefore a larger density) have a more uniform distribution of current on the substrate 102. Plates with through holes 112 having a smaller diameter also have a relatively higher total pressure drop (high viscous flow resistance).

In some embodiments, the through holes 112 have a diameter less than about 0.2 times the gap or the distance between the ionically resistive element 107 and the substrate 102. The through holes 112 are generally circular in cross section but need not be. Further, the through holes 112 may have the same diameter although this need not be the case. The size, shape, and the density of the through holes 112 may vary across the ionically resistive element 107 depending on application.

FIG. 1C illustrates a condition that can occur during electroplating in the apparatus shown in FIGS. 1A and 1B. For example, a pressure differential can occur between the cross flow manifold 110 and the second manifold 111. For example, the cross flow manifold 110 can be at a higher pressure due to a significant amount of electrolyte flowing through the side inlet 113 while the second manifold 111 is at a lower pressure. These manifolds 110, 111 are separated by the ionically resistive element 107. Due to the pressure differential, some of the electrolyte delivered through the side inlet 113 may travel downward/backward through the openings (through holes 112) in the ionically resistive element 107 into the second manifold 111. The electrolyte may then travel back up through the ionically resistive element 107 through the openings (through holes 112) when the electrolyte is near the side outlet 114.

Accordingly, the electrolyte that is intended to shear over the substrate 102 in the cross flow manifold 110 may bypass the cross flow manifold 110 by flowing through the second manifold 111. This undesired electrolyte flow is shown in FIG. 1C using dotted arrows. The flow of electrolyte downward through the ionically resistive element 107 is undesirable because the electrolyte delivered through the side inlet 113 is intended to shear over the plating face of the substrate 102 within the cross flow manifold 110. Any electrolyte that travels down through the ionically resistive element 107 can no longer shear over the plating face of the substrate 102 as desired. The undesired electrolyte flow results in lower than desired convection at the plating surface of the substrate 102 and non-uniform convection over different portions of the substrate 102. The undesired electrolyte flow can cause substantial plating non-uniformities on the substrate 102.

FIGS. 2A-2E show baffles 130 used to reduce and/or control the degree to which the electrolyte delivered to the cross flow manifold 110 can bypass the cross flow manifold 110. FIG. 2A shows one or more baffles 130 provided in the second manifold 111 to reduce the degree to which electrolyte can travel across the electroplating cell (e.g., in the direction of cross flowing electrolyte) within the second manifold 111.

The baffles 130 extend vertically and parallelly from the membrane 105 to the ionically resistive element 107. The baffles 130 also extend linearly across the space between the membrane 105 and the ionically resistive element 107 (i.e., across the second manifold 111). Accordingly, the baffles 130 are arranged perpendicular to the direction of flow of the electrolyte within the cross flow manifold 110. The baffles 130 divide the second manifold 111 into a plurality of regions (compartments) 139 between the membrane 105 and the ionically resistive element 107. The baffles may also be called walls or partitions.

FIG. 2B shows examples of the baffles 130. FIGS. 2C and 2D illustrate a back side insert 135 including a plurality of baffles 130. FIG. 2C shows the back side insert 135 when viewed from below the back side insert 135 (bottom view). FIG. 2D shows the back side insert 135 when viewed from above the back side insert 135 (top view).

The back side insert 135 is installed below the ionically resistive element 107 and above the membrane frame 106. The back side insert 135 is installed proximate to the back side (e.g., underside/lower side) of the ionically resistive element 107. The back side insert 135 may be clamped between the membrane frame 106 and the ionically resistive element 107.

Figure 2E:
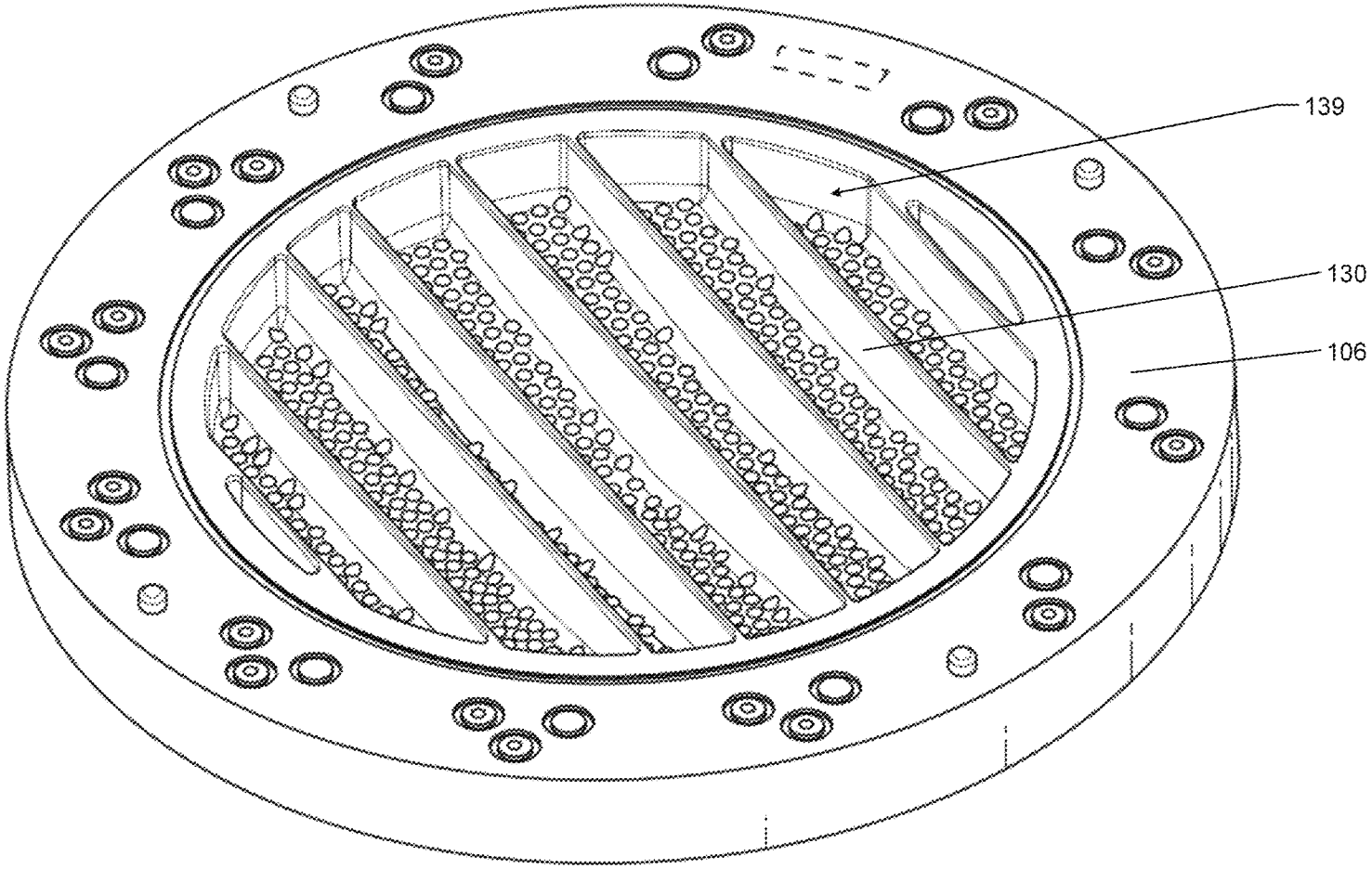
FIG. 2E shows a top view of a membrane frame of the electroplating cell along with the baffles and shows a plurality of regions (compartments) formed by the baffles.

FIG. 2E shows a top view of the membrane frame 106 along with the baffles 130. FIG. 2E shows the plurality of regions 139 formed by the baffles 130. The baffles 130 may be formed as part of the ionically resistive element 107, the membrane frame 106, or the back side insert 135. Alternatively, the baffles 130 may be separate pieces of hardware or may be a single unit.

During electroplating, the baffles 130 prevent the electrolyte from flowing across the electroplating cell (e.g., left-to-right in the example shown) within the second manifold 111. As a result, a greater proportion of the electrolyte delivered to the side inlet 113 is maintained within the cross flow manifold 110 rather than descending through the ionically resistive element 107 into the second manifold 111, which would occur without the baffles 130.

In some implementations, only a single baffle may be used. The single baffle may be located near the side inlet 113, near the center of the substrate 102, or near the side outlet 114. In some implementations, two, three, four, five, six, or more baffles may be used.

The baffles 130 may be spaced from each other evenly or unevenly in any suitable manner. For example, the distance between adjacent baffles 130 may be between about 10 mm-30 mm, or between about 5 mm-150 mm. For example, the thickness of each baffle 130 may be between about 0.5 mm-1.5 mm, or between about 0.25 mm-3 mm.

The baffles 130 may have different dimensions so that each baffle 130 matches the shape of the second manifold 111 at the position where each baffle 130 is located. In some implementations, the baffles 130 may extend all the way to the edges of the ionically resistive element 107, all the way to the edges of the membrane frame 106, and all the way across the electroplating cell 101. The baffles 130 provide a relatively high resistance to the flow of the electrolyte since there is no space for the electrolyte to squeeze around the baffles 130.

Figure 3:
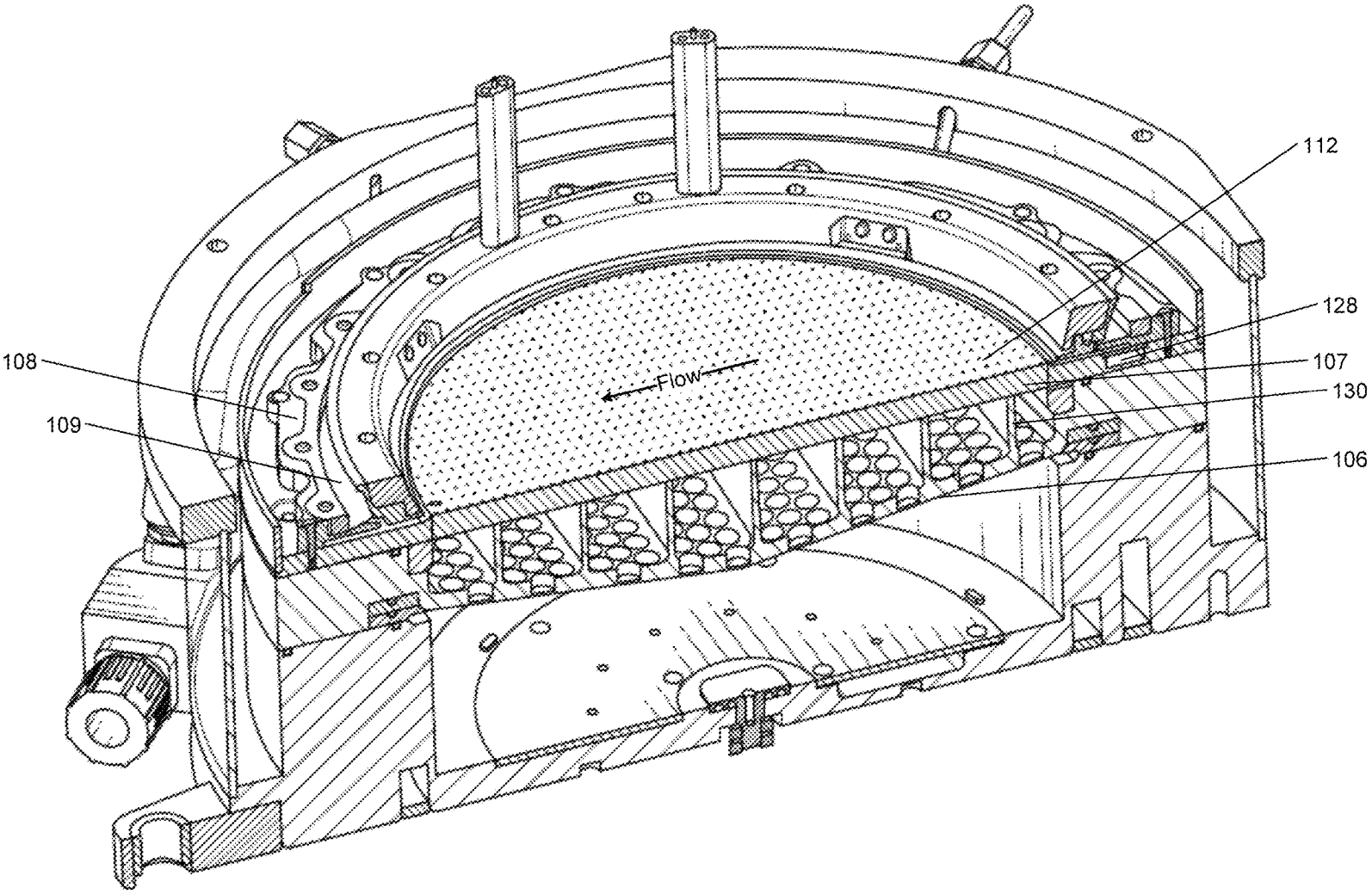
FIG. 3 shows another cross-sectional view of the electroplating cell.

FIG. 3 shows another cross-sectional view of the electroplating apparatus shown in FIGS. 1A-2E. The electrolyte is injected into an injection manifold 128. Another view of the injection manifold 128 is shown in FIG. 8B.

Figure 4:
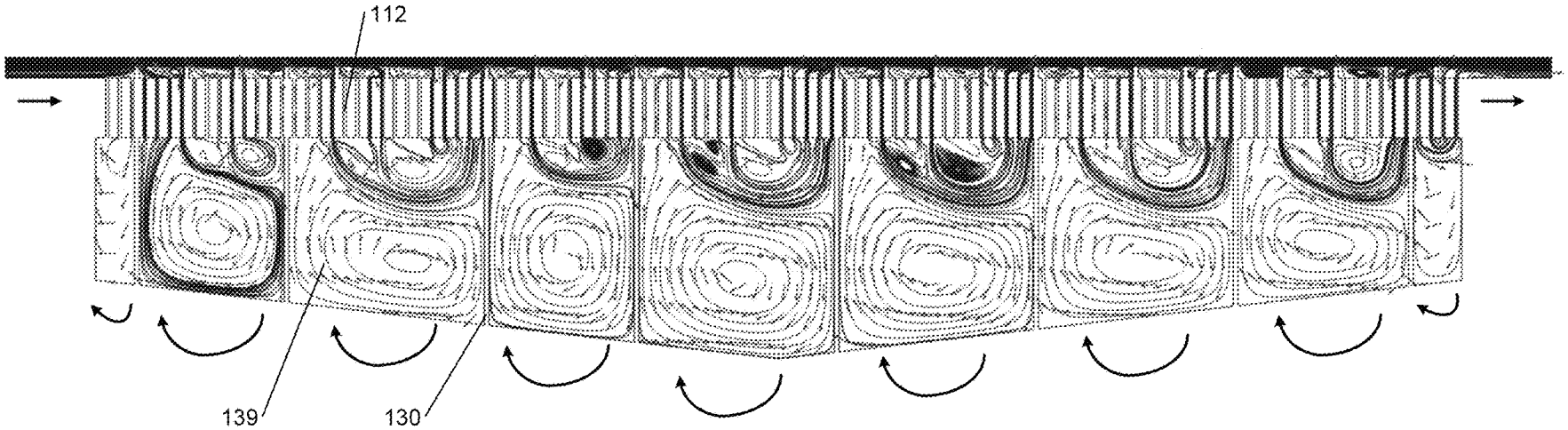
FIG. 4 shows a model of flow of an electrolyte through the regions formed by the baffles.

FIG. 4 shows a model of the flow of electrolyte through the regions 139 formed by the baffles 130. While the arrows in the regions 139 show the convection, the external arrows indicate the overall direction of the flow of electrolyte through the regions 139. As will be described with reference to FIG. 7B, the flow of the electrolyte can be focused in one or more regions 139 by using one or more specially designed substrates (shown in FIGS. 9B-9D) to remove air bubbles formed under the ionically resistive element 107 (shown in FIG. 5). Any air bubbles that may be trapped in the through holes 112 in the ionically resistive element 107 can also be similarly removed.

Figure 5:
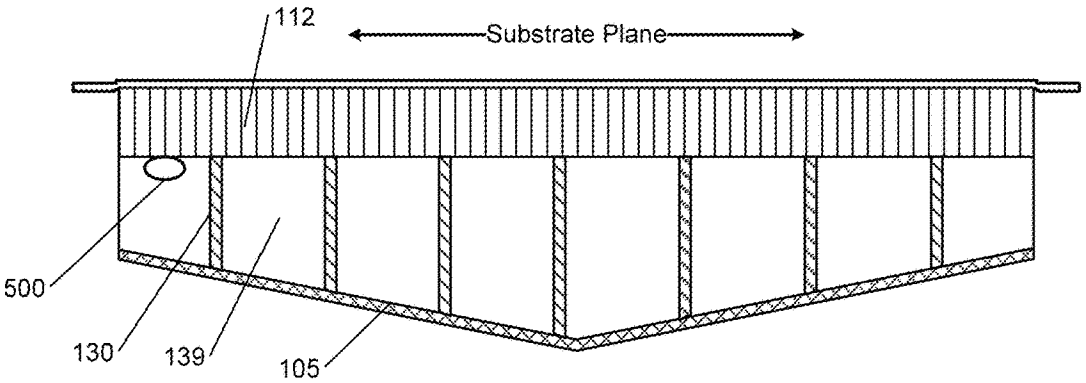
FIG. 5 shows an air bubble formed under an ionically resistive element of the electroplating cell.

FIG. 5 shows an air bubble 500 formed under the ionically resistive element 107. While only one air bubble is shown, hundreds or thousands of air bubbles can collect under the ionically resistive element 107. While not shown, air bubbles can also be trapped in the through holes 112.

Figure 6:
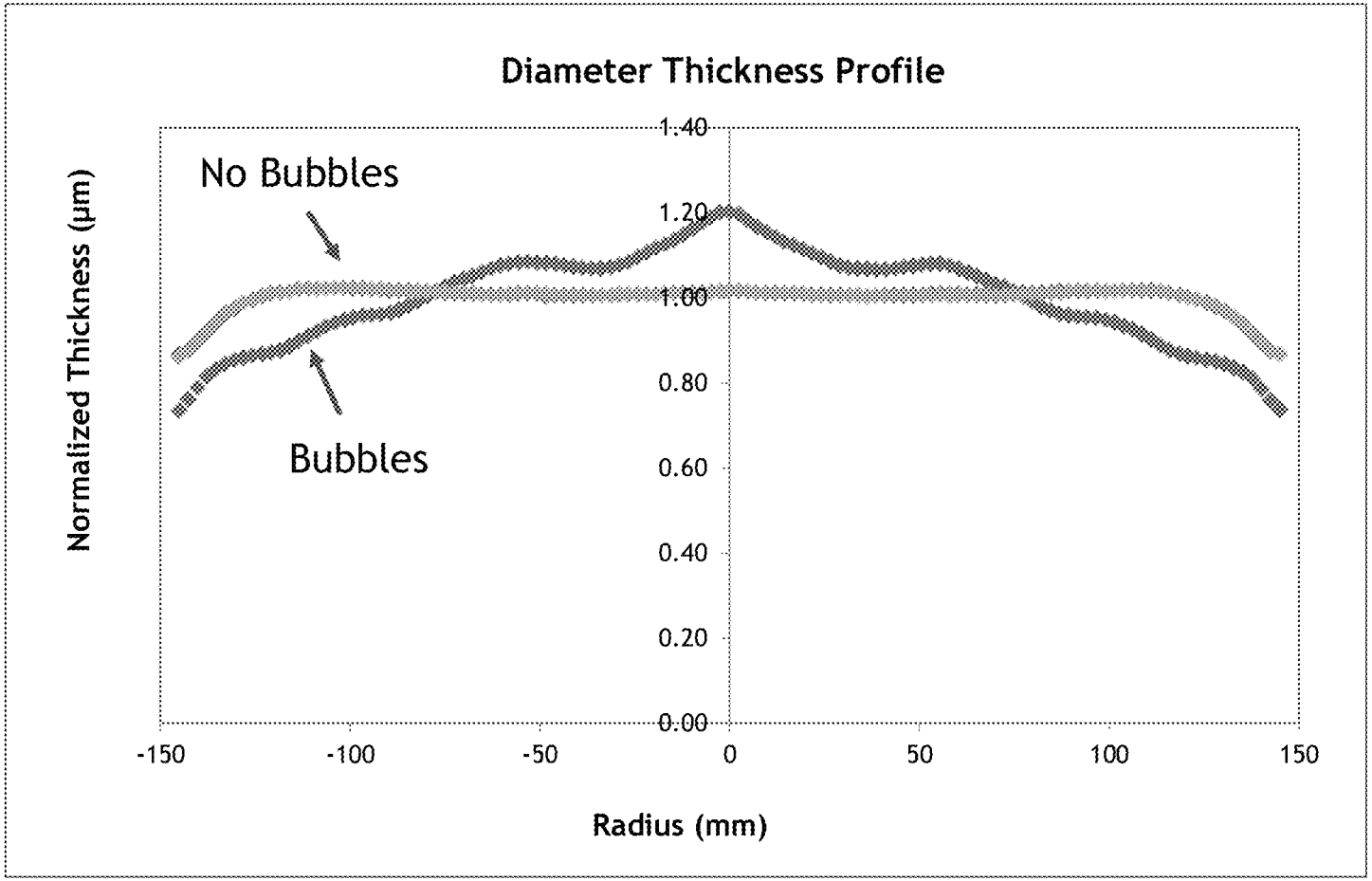
FIG. 6 shows effects of air bubbles on electrical and flow resistances of the ionically resistive element.

FIG. 6 shows the effect of the air bubbles on the electrical and flow resistances of the ionically resistive element 107. FIG. 6 shows that the presence of the air bubbles alters (increases) the electrical and flow resistances of the ionically resistive element 107. This is because air is a bad conductor of electricity, and air bubbles tend to obstruct fluid flow. As a result, due to the presence of the air bubbles, a next substrate may not be correctly electroplated. That is, the air bubbles can cause non-uniform electrodeposition on the next substrate.

Currently, these air bubbles are manually removed using a hand pump. The process of manually removing the air bubbles using the hand pump takes time, which increases the downtime of the tool used for electroplating substrates. Instead, the present disclosure automates the process of removing air bubbles by using specially designed substrate as described below.

Figure 7A:
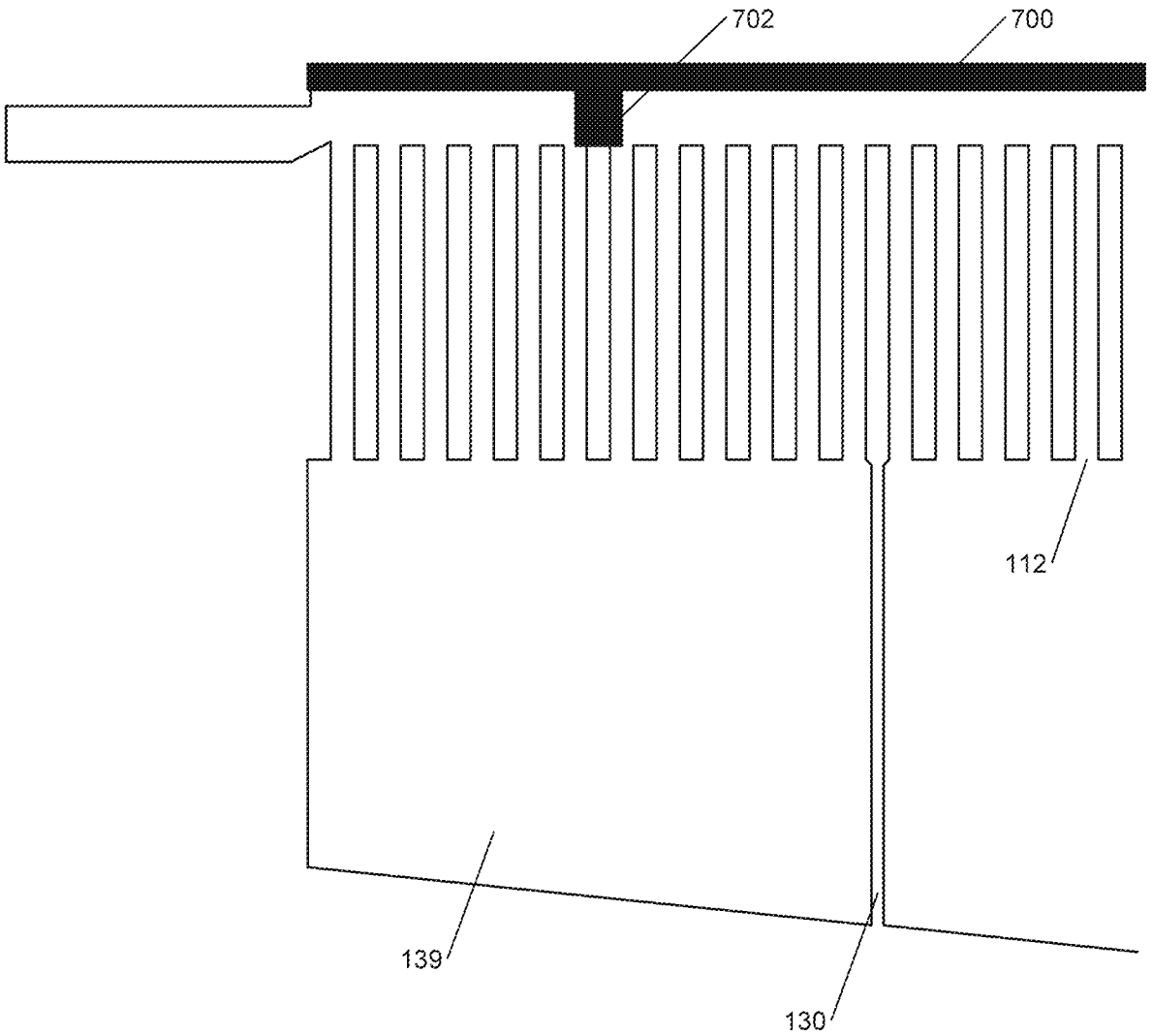
FIGS. 7A and 7B show an example of a substrate with a protuberance used to remove air bubbles formed under an ionically resistive element of the electroplating cell.
Figure 7B:
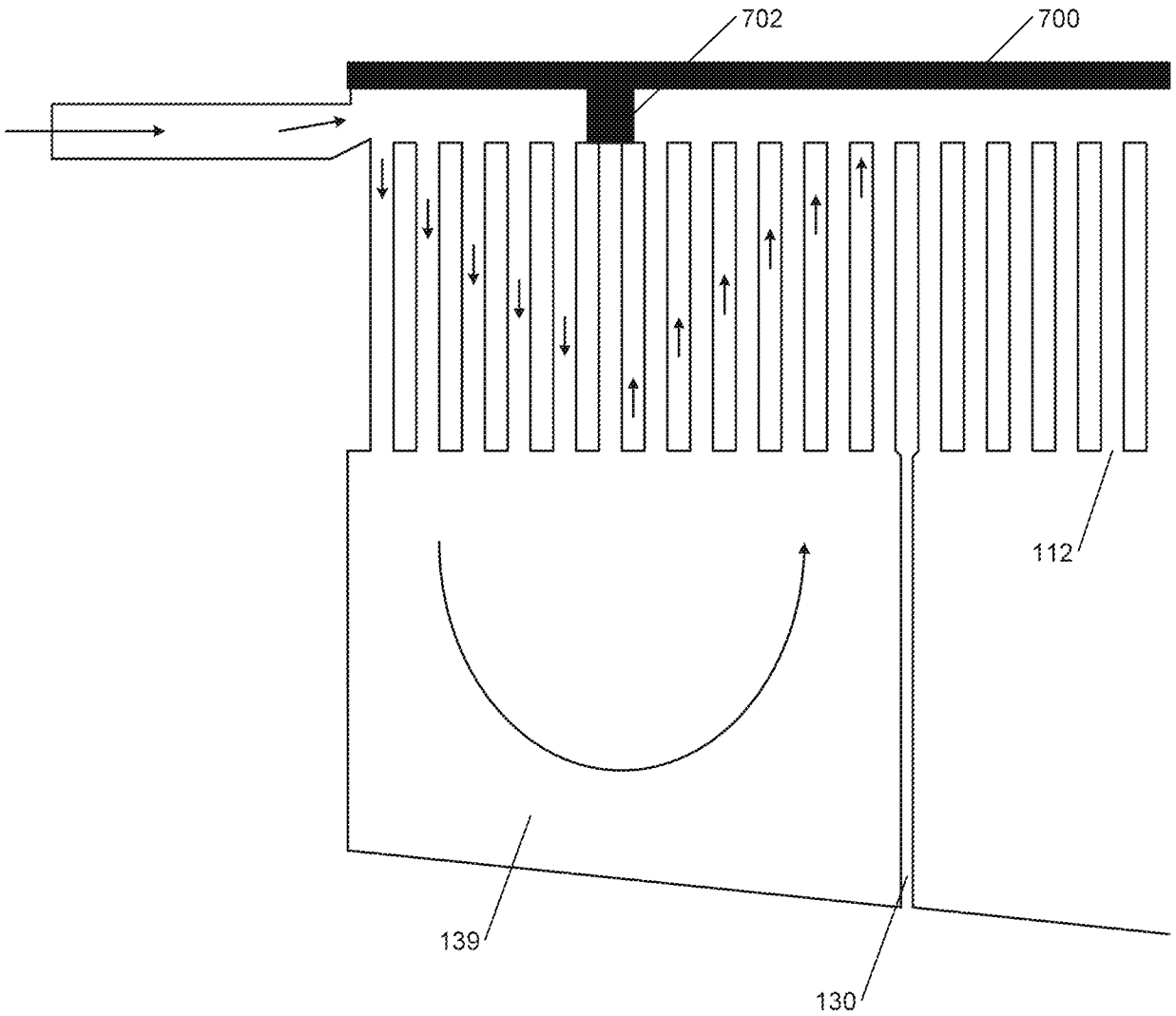

FIGS. 7A and 7B show an example of a substrate 700 with a protuberance 702 according to the present disclosure. The substrate 700 is used to remove the air bubbles (e.g., the air bubble 500 shown in FIG. 5) from under the ionically resistive element 107. The substrate 700 can also be used to remove any air bubbles that may be trapped in the through holes 112.

The substrate 700 with the protuberance 702 may also be called a dummy substrate because unlike other substrates that are electroplated, the substrate 700 is not electroplated. Instead, the substrate 700 is used to focus the flow of the electrolyte as shown in FIG. 7B to remove the air bubbles. Accordingly, the substrate 700 may also be called a flow focusing substrate.

The material used for the substrate 700 may be the same as or different than actual substrates that are electroplated. Regardless of the material used, some properties of the substrate 700 (e.g., optical properties such as reflectivity, etc.) may be similar to the actual substrates that are electroplated. Accordingly, a tool (explained with reference to FIG. 10) that is used to handle the actual substrates can also handle the substrate 700 similar to the actual substrates. That is, the tool can handle the substrate 700 as if the substrate 700 is an actual substrate to be electroplated.

FIG. 7A shows that the substrate 700 is placed in the substrate holder 103 and then lowered to the plating position similar to a regular substrate to be electroplated. The plating position is proximate to (i.e., immediately above) the top surface of the ionically resistive element 107. The substrate 700 is placed in the substrate holder 103 and lowered to the plating position by the tool described with reference to FIG. 10. That is, the substrate 700 is not handled manually, which eliminates the possibilities of contamination and time delays. The substrate 700 is positioned such that the protuberance 702 touches or contacts the top surface of the ionically resistive element 107. The substrate 700 is positioned above one of the regions 139 formed by the baffles 130. The protuberance 702 may or may not be positioned at a center of the region 139.

FIG. 7B shows that when the electrolyte is injected, the electrolyte flows into and out of the region 139 in the direction shown by the arrows. Specifically, the electrolyte flows into the region 139 via the through holes 112 that are on a first side (e.g., left side when the electrolyte flows left to right as shown) of the protuberance 702. The electrolyte flows out of the region 139 via the through holes 112 that are on a second side (e.g., right side in the example shown) of the protuberance 702. The flow of the electrolyte via the through holes 112 and the region 139 as shown by the arrows forces any air bubbles out of the region 139. The flow of the electrolyte expels any air bubbles that may be trapped under and/or within a portion of the ionically resistive element 107 associated with the region 139. This process is repeated for all the regions 139 as explained below to extinguish all the air bubbles from under and/or within the entirety of the ionically resistive element 107.

Figure 8A:
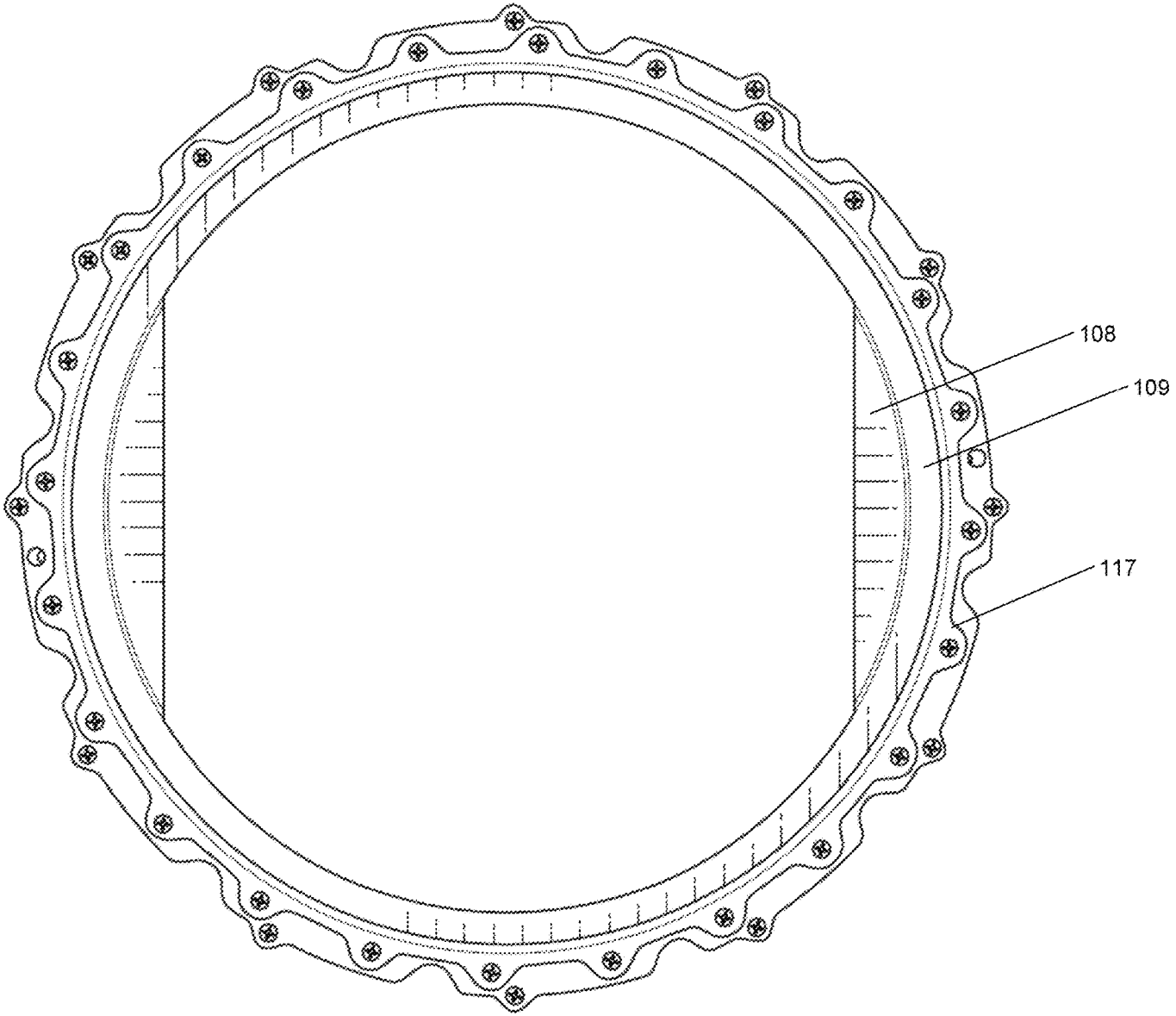
FIGS. 8A and 8B show different views of a dynamic seal used to prevent leakage and improve flow of the electrolyte in the electroplating cell.
Figure 8B:
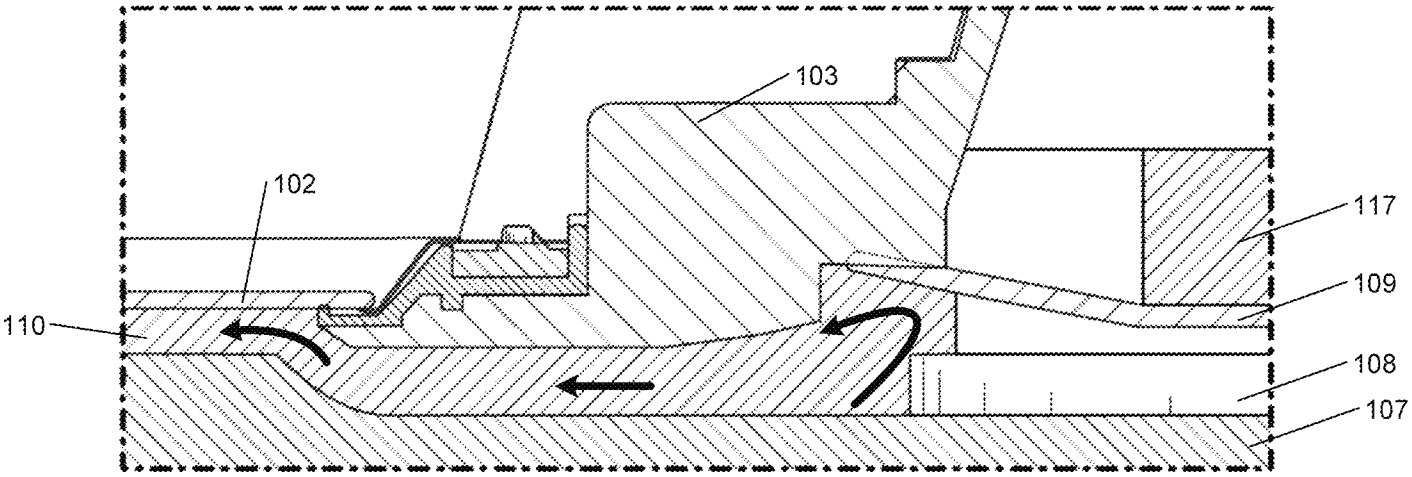

FIGS. 8A and 8B show the dynamic seal 109 in detail. FIG. 8A shows a view of the dynamic seal 109 without showing the ionically resistive element 107 for clarity. FIG. 8B shows a cross-sectional view of the dynamic seal 109 along with the ionically resistive element 107, the substrate holder 103, and the substrate 700 (or 102).

FIG. 8A shows that the dynamic seal 109 is arranged between the front side insert 108 and a clamping ring 117. The front side insert 108 serves as a support structure or ring with wide side walls. The front side insert 108 is arranged at the bottom of the dynamic seal 109. The clamping ring 117 is arranged at the top of the dynamic seal 109. The dynamic seal 109 may be made of a flexible and durable material such as polytetrafluoroethylene (PTFE) that can withstand the harsh chemistry of the electrolyte.

FIG. 8B shows that during electroplating and removing the air bubbles, the flow of the electrolyte pushes the dynamic seal 109 against the substrate holder 103, which prevents the electrolyte from leaking. In turn, since the dynamic seal 109 is pushed against the substrate holder 103, the full flow of the electrolyte (shown by the arrows) is available for removing air bubbles as described with reference to FIGS. 7A and 7B above and FIGS. 9A-9D below. The full flow of the electrolyte is also available for electroplating the substrate 102 during electroplating.

Figure 9A:
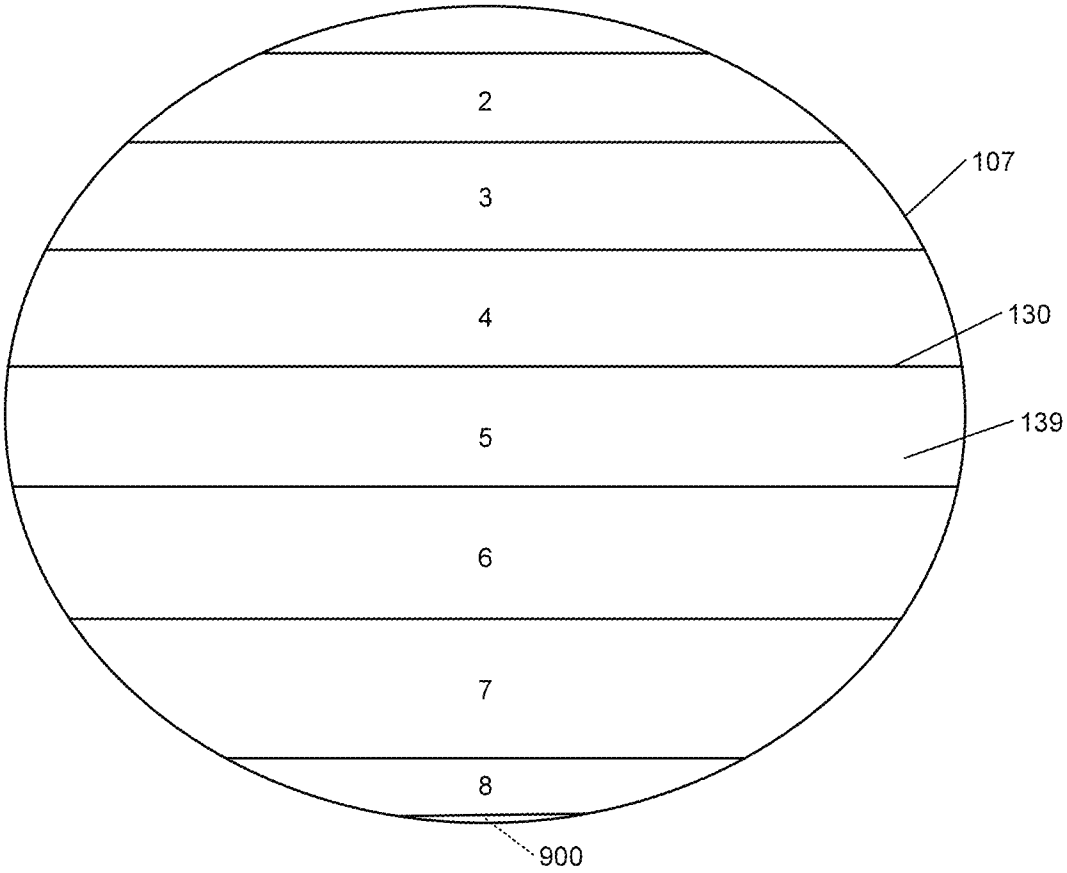
FIGS. 9A-9E show different configurations of the substrate and the protuberance that can be used to remove the air bubbles in the electroplating cell.

FIGS. 9A-9E show different configurations of the substrate 700, the protuberance 702, and different schemes that can be used for removing the air bubbles. FIG. 9A shows a schematic of a top view of the ionically resistive element 107 without the through holes 112 and without the air bubbles, which are presumed present under the ionically resistive element 107 and in the through holes 112. Only the baffles 130 and the regions 139 formed by the baffles are schematically shown. For example, only seven baffles 130 and eight regions 139 are shown. The procedure for removing the air bubbles explained above with reference to FIGS. 7A and 7B is performed on all of the regions 139 shown in FIG. 9A as explained below with reference to FIGS. 9B-9E.

Figure 9B:
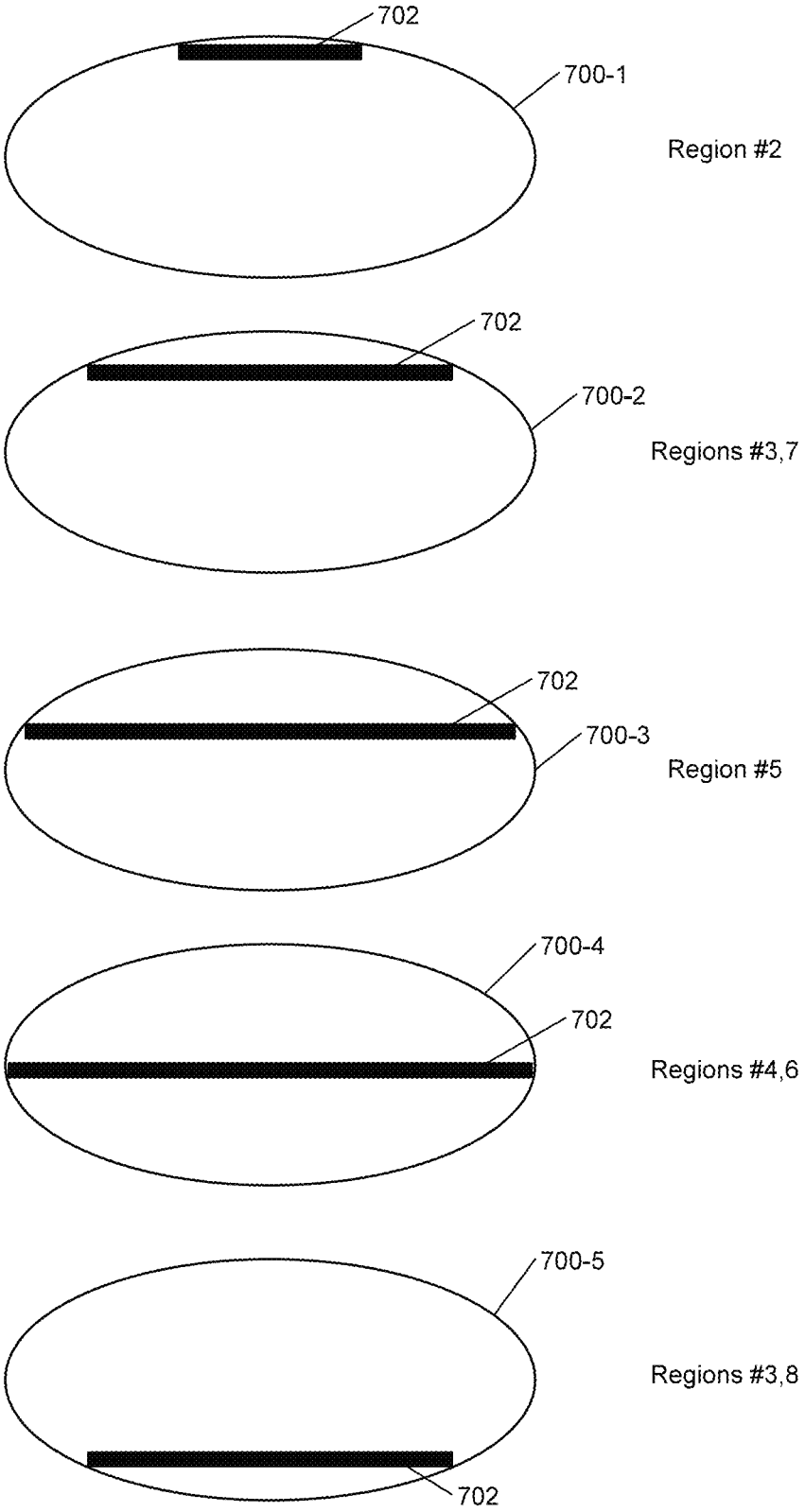

FIG. 9B shows an example scheme for removing air bubbles from the eight regions 139 shown in FIG. 9A. The example scheme includes five substrates 700-1, 700-2, 700-3, 700-4, and 700-5 (collectively substrates 700). Each substrate 700 includes the protuberance 702 arranged at a different location. The location of the protuberance 702 on each substrate 700 is selected so that the protuberance 702 will align with a different one of the regions 139.

Each substrate 700 is used for a predetermined time (e.g., 30 seconds) to remove the air bubbles associated with one of the regions 139 as explained above with reference to FIGS. 7A and 7B. Subsequently, the tool lifts the substrate 700 from the plating position above the de-bubbled region 139, rotates the substrate 700 by 180 degrees, and lowers the substrate 700 to the plating position so that the protuberance 702 on the substrate 700 aligns with a different region 139. The procedure to remove the air bubbles is repeated for another predetermined time to remove the air bubbles from the different region 139. Subsequently, a different substrate 700 is picked, and the process is repeated for the remaining regions 139 until all the substrates 700 are used, and all the regions 139 are de-bubbled.

For example, the protuberance 702 on the substrate 700-1 aligns with the second region 139 (region #2 shown in FIG. 9A), and the substrate 700-1 is used to de-bubble the second region 139. The protuberance 702 on the substrate 700-2 aligns with the third and seventh regions 139 (regions #3, 7 shown in FIG. 9A), and the substrate 700-2 is used to de-bubble the third and seventh regions 139. The protuberance 702 on the substrate 700-3 aligns with the fifth region 139 (region #5 shown in FIG. 9A), and the substrate 700-3 is used to de-bubble the fifth region 139. The protuberance 702 on the substrate 700-4 aligns with the fourth and sixth regions 139 (regions #4, 6 shown in FIG. 9A), and the substrate 700-4 is used to de-bubble the fourth and sixth regions 139. The protuberance 702 on the substrate 700-5 aligns with the third and eighth regions 139 (regions #3, 8 shown in FIG. 9A), and the substrate 700-5 is used to de-bubble the third and eighth regions 139.

In some cases, the substrate may be rotated again back to the original region, and the procedure to remove the air bubbles may be repeated for the original region. In some cases, the substrate may be rotated multiple times back and forth over the two regions being de-bubbled, and the procedure to remove the air bubbles may be repeated for the two regions. In some cases, the predetermined time for which the procedure is performed may be varied after each rotation. Over time, the tool may learn and fine tune the amounts of these predetermined times for each electroplating recipe.

The protuberance 702 can be constructed on the substrate in various ways. For example, in one implementation, the protuberance 702 may be built into (i.e., integrated with) the substrate 700. That is, the substrate 700 may be manufactured with the protuberance 702 as an integral part of the substrate 700. Instead, in some implementations, the protuberance 702 may be a gasket installed or affixed on the substrate 700. The dimensions (width and height) of the protuberance 702 may depend on factors including the dimension of the through holes 112, the width of the regions 139 (i.e., spacing between the baffles 130), etc.

Figure 9C:
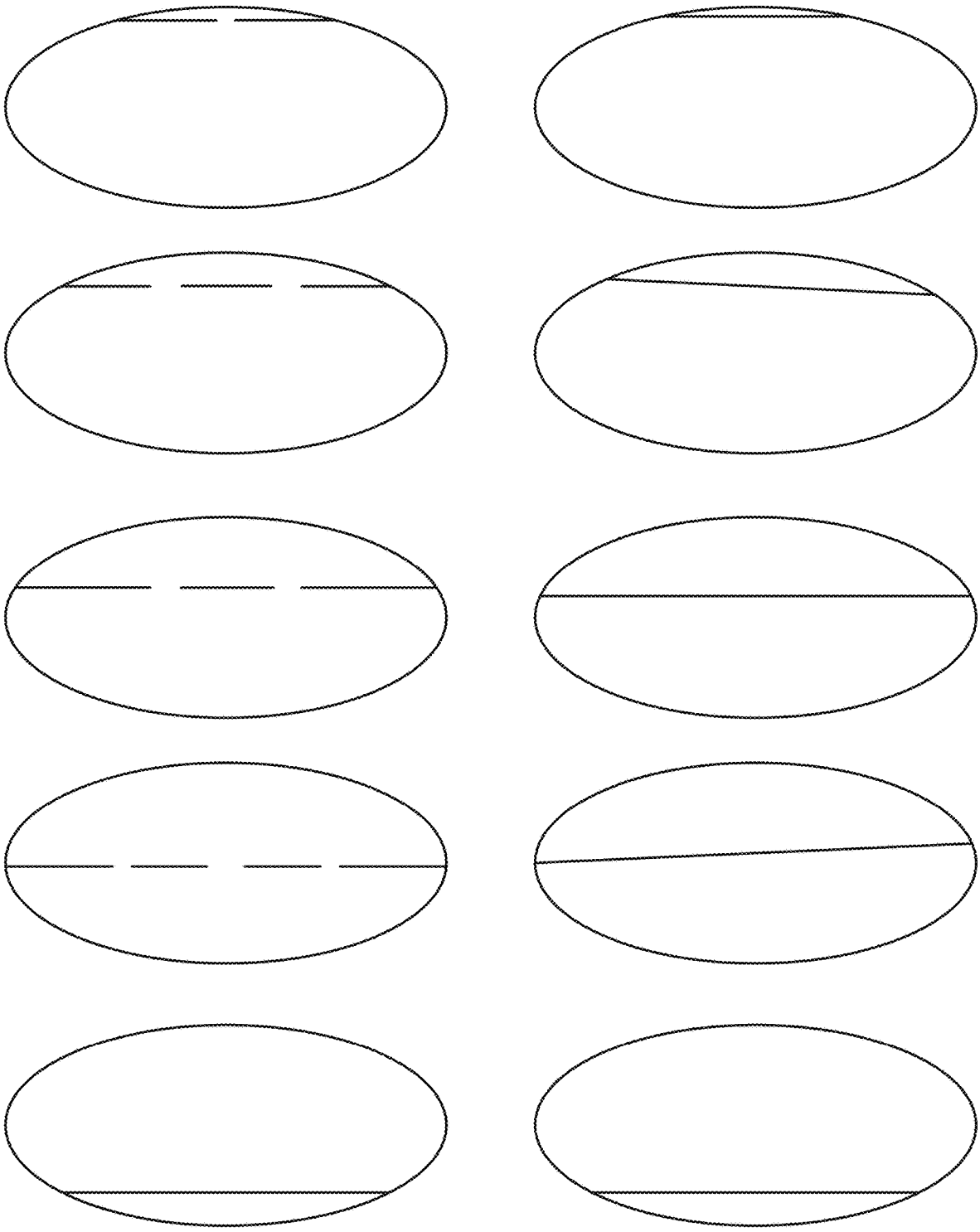
Figure 9D:
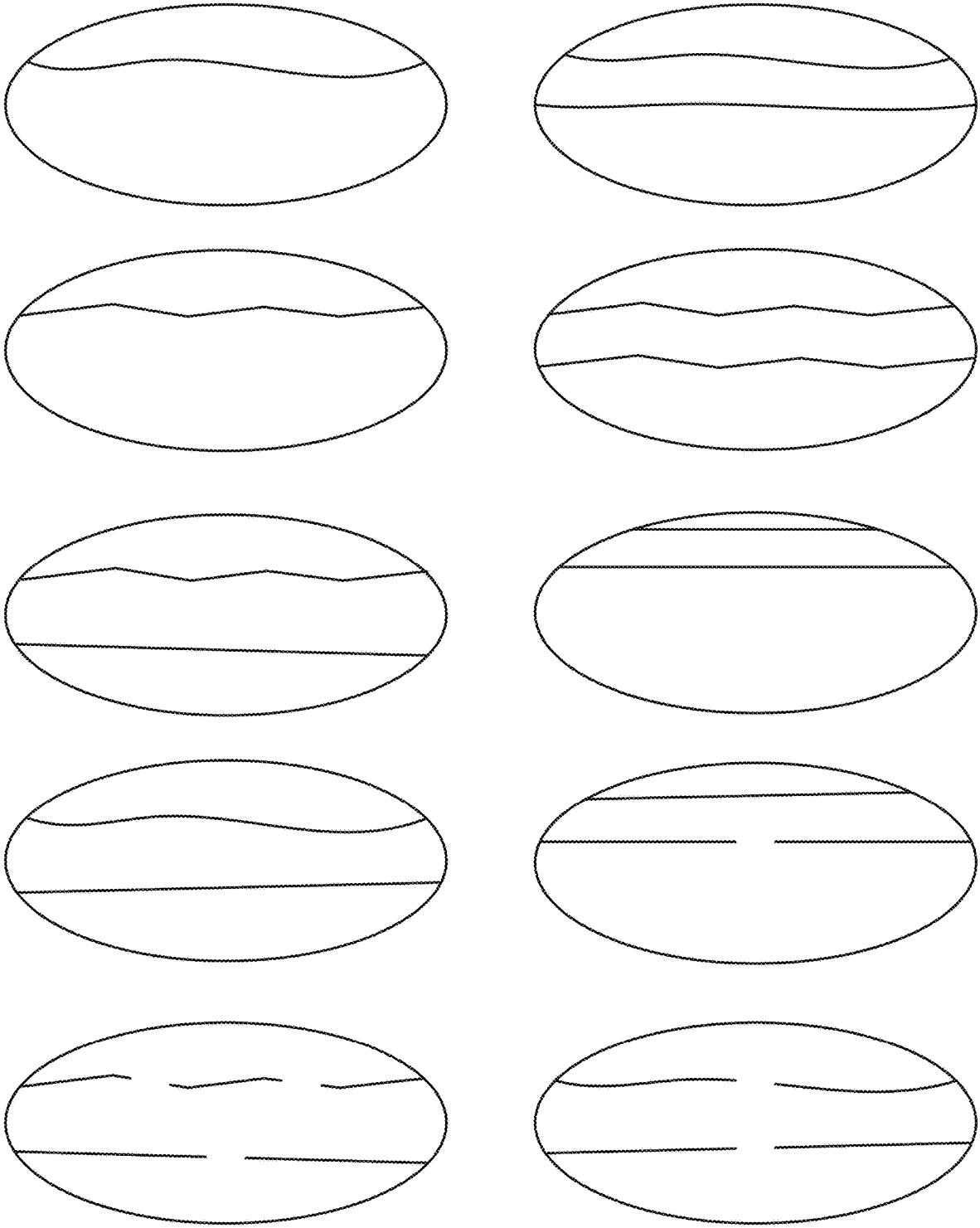

FIGS. 9C and 9D show various designs and arrangements of the substrate 700 and the protuberance 702 that can be used to optimize the removal of the air bubbles. For example, while the protuberance 702 is shown in FIG. 9B as a straight line, in some implementations, the protuberance 702 may not be a straight line. Rather, the protuberance 702 may be a jagged line as shown in FIG. 9D. The protuberance 702 may be wavy (e.g., serpentine) or zigzag in shape as shown in FIG. 9D.

While only one protuberance 702 per substrate is shown in FIG. 9B, in some implementations, more than one protuberance 702 may be arranged on a single substrate 700 as shown in FIG. 9D. Further, when more than one protuberance 702 is arranged on a single substrate 700, one protuberance 702 may be a straight line while another protuberance 702 may not be a straight line as shown in FIG. 9D.

Fewer substrates and substrate rotations may be used if more than one protuberance 702 per substrate is used. In one example, a single substrate may be used, where the number of protuberances on the substrate matches the number of regions 139 to be de-bubbled. In this example, no rotation is needed.

In some implementations, when multiple substrates 700 are used, one or more substrates 700 may include the protuberance 702 as a straight line while one or more substrates 700 may include the protuberance 702 that is not a straight line. Further, one or more substrates 700 may include a single protuberance 702 while one or more substrates 700 may include more than one protuberance 702 per substrate.

FIG. 9C shows additional design variations of the substrate 700 and the protuberance 702. For example, the protuberance 702 may be discontinuous. That is, the protuberance 702 may have one or more gaps. Further, in some cases, a gap in the protuberance 702 on one substrate may align with a gap in the protuberance 702 on another substrate. In other cases, a gap in the protuberance 702 on one substrate may not align with a gap in the protuberance 702 on another substrate. Rather, the gaps in the protuberances 702 on the substrates 700 may be staggered.

In some cases, the gaps may align on alternating substrates 700, and/or the gaps may be staggered on alternating substrates 700. Further, when multiple substrates are used, one or more substrates 700 may have the gaps in the protuberances 702 while one or more substrates 700 may not have the gaps in the protuberances 702. Furthermore, the teachings regarding the gaps can be combined with the various designs of the substrates 700 and protuberances 702 previously described (e.g., nonlinear protuberances, multiple protuberances per substrate, etc.). For example, as shown in FIG. 9D, when multiple protuberances per substrate are used, one protuberance on a substrate may include gaps while another protuberance on the same substrate may not include gaps. Further, the gaps of the protuberances on the same substrate may be aligned and/or staggered as shown in FIG. 9D.

In some implementations, the protuberance 702 may be oblique or slanted as shown in FIG. 9C. The teachings of the gaps can be added to the oblique or slanted protuberances as shown in FIG. 9C. Furthermore, the teachings regarding the oblique or slanted protuberances and the gaps can be combined with the various designs of the substrates 700 and protuberances 702 previously described (e.g., nonlinear protuberances, multiple protuberances per substrate, etc.) as shown in FIG. 9D.

Figure 9E:
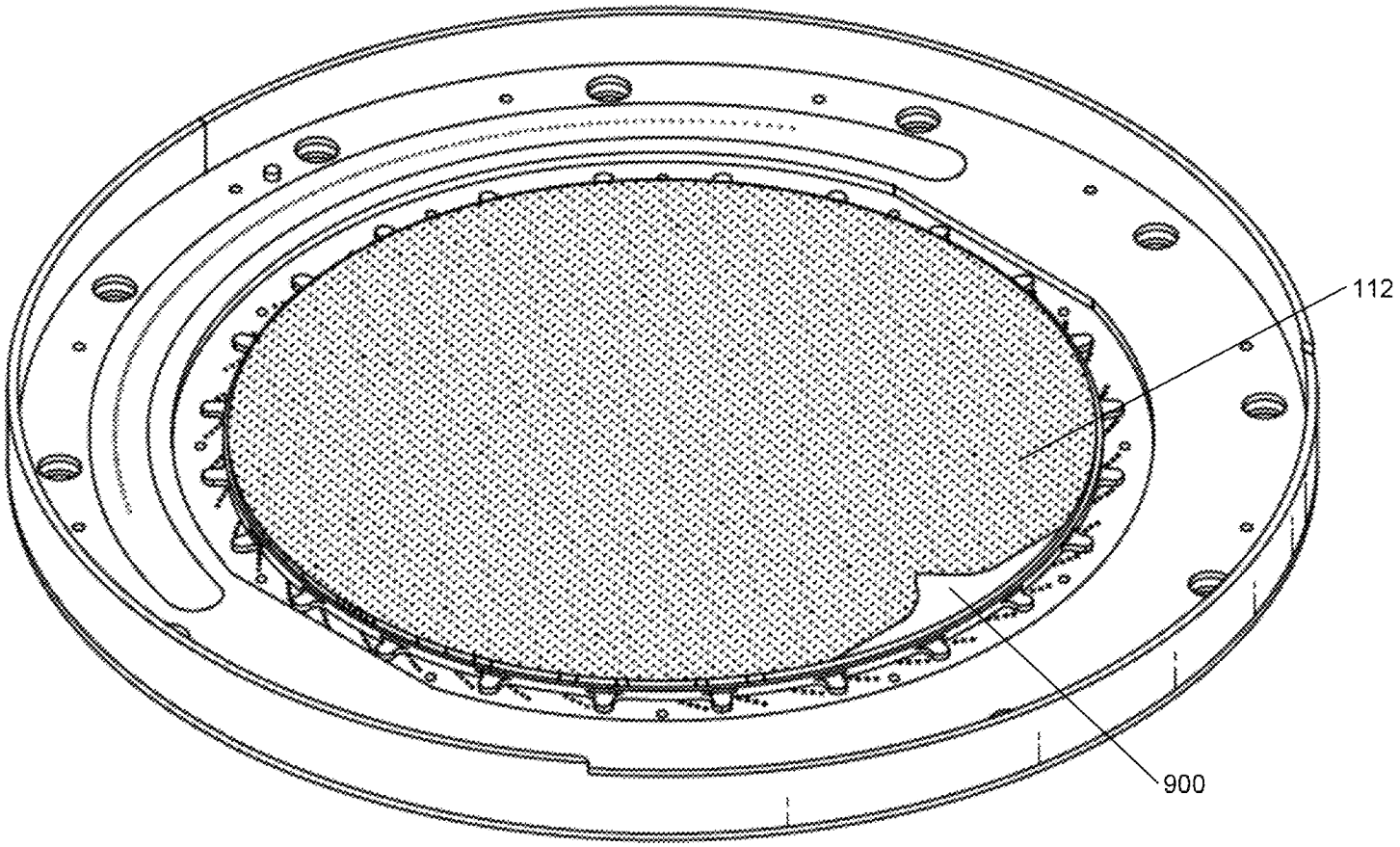

FIG. 9E shows a feature of the ionically resistive element 107. The ionically resistive element 107 includes a raised tab 900 for current control. For example, the raised tab may be adjacent to region #8 (see FIG. 9A). Accordingly, when the substrate 700-1 is used to de-bubble region #2, the substrate 700-1 cannot be rotated by 180 degrees to de-bubble a region surrounding the raised tab 900. To de-bubble the region surrounding the raised tab 900, the protuberance 702 on the substrate 700-1 needs to have a gap (e.g., see FIG. 9C) that prevents the protuberance 702 from contacting the raised tab 900 when the substrate 700-1 is rotated after de-bubbling region #2 and is placed above the raised tab 900.

Figure 10:
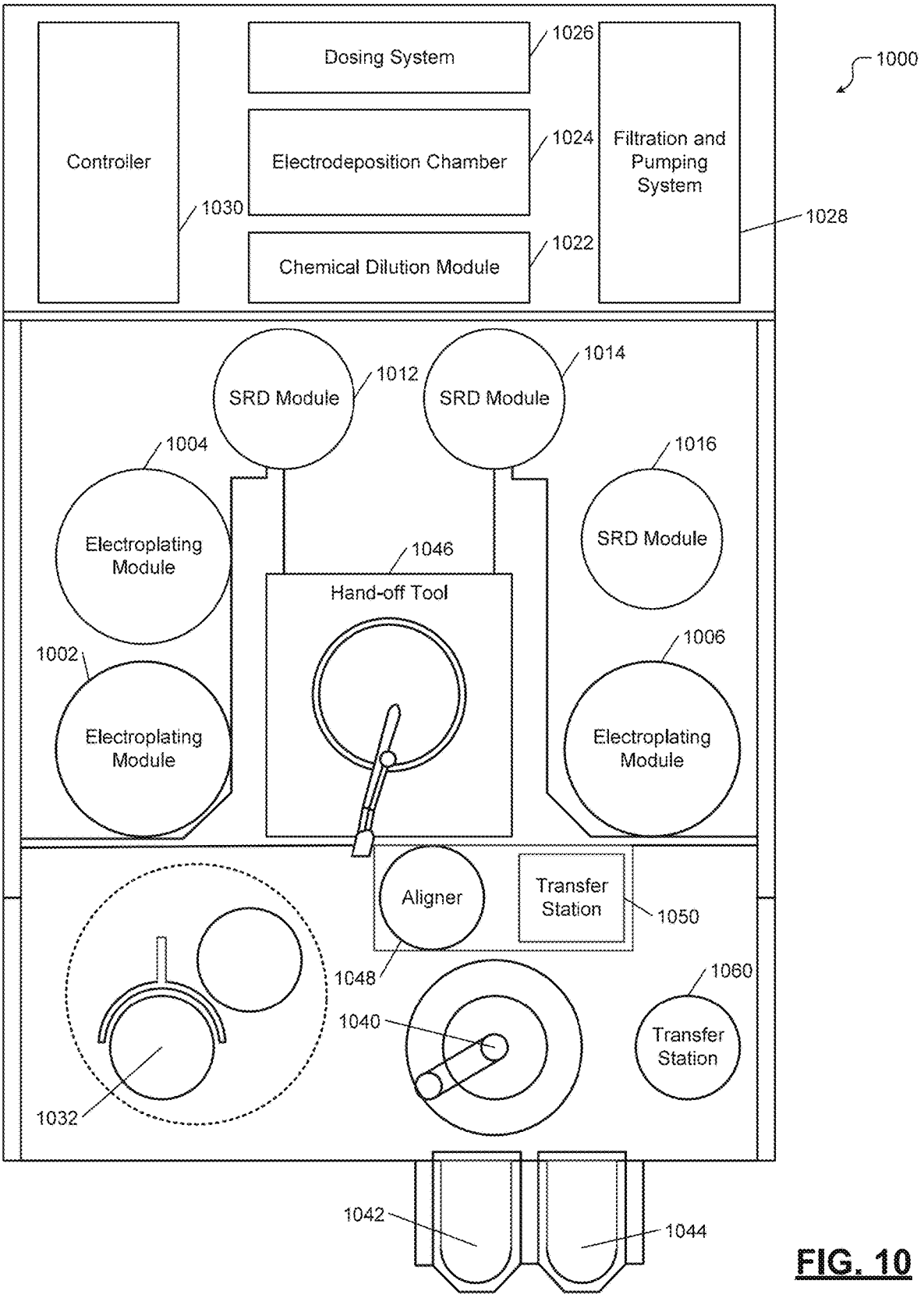
FIG. 10 shows a schematic of a top view of an example of an electrodeposition apparatus.

FIG. 10 shows a schematic of a top view of an example of an electrodeposition apparatus 1000. The electrodeposition apparatus 1000 can include one or more electroplating modules (EPMs) 1002, 1004, and 1006. The electrodeposition apparatus 1000 can also include one or more modules 1012, 1014, and 1016 configured for various process operations. For example, in some embodiments, one or more of the modules 1012, 1014, and 1016 may be a spin rinse drying (SRD) module. In other embodiments, one or more of the modules 1012, 1014, and 1016 may be post-electrofill modules (PEMs). Each of the modules 1012, 1014, and 1016 may be configured to perform a function such as edge bevel removal, backside etching, and acid cleaning of substrates after the substrates are processed by one of the electroplating modules 1002, 1004, and 1006.

The electrodeposition apparatus 1000 includes a central electrodeposition chamber 1024. The central electrodeposition chamber 1024 is a chamber that holds the chemical solution used as the electroplating solution in the electroplating modules 1002, 1004, and 1006. The electrodeposition apparatus 1000 also includes a dosing system 1026 that may store and deliver additives for the electroplating solution. A chemical dilution module 1022 may store and mix chemicals to be used as an etchant. A filtration and pumping system 1028 may filter the electroplating solution for the central electrodeposition chamber 1024 and pump the filtered electroplating solution to the electroplating modules 1002, 1004, and 1006. A system controller 1030 provides various interfaces and controls to operate the electrodeposition apparatus 1000. The system controller 1030 controls the operations of the electroplating apparatus 1000 as described below.

Signals for monitoring the processes performed by the various modules of the electrodeposition apparatus 1000 may be provided by analog and/or digital inputs of the system controller 1030 from various sensors (not shown) installed throughout the electrodeposition apparatus 1000. The signals for controlling the processes may be output on analog and digital outputs of the system controller 1030. Non-limiting examples of the sensors include mass flow sensors, pressure sensors (e.g., manometers), temperature sensors (e.g., thermocouples), optical position sensors, etc.

A hand-off tool 1040 may select a substrate (e.g., substrate 102 or 700) from a substrate cassette such as a cassette 1042 or a cassette 1044. The cassettes 1042 or 1044 may be front opening unified pods (FOUPs). A FOUP is an enclosure designed to hold substrates securely in a controlled environment and to allow the substrates to be removed for processing or measurement by tools equipped with appropriate loading ports and robotic handling systems. The hand-off tool 1040 may hold a substrate using a vacuum attachment or some other attaching mechanism.

The hand-off tool 1040 may interface with a wafer handling station 1032, the cassettes 1042 or 1044, transfer stations 1050 and 1060, and/or an aligner 1048. From the transfer stations 1050 and 1060, a hand-off tool 1046 may gain access to a substrate (e.g., substrate 102 or 700). The transfer stations 1050 and 1060 may be a slot or a position from and to which the hand-off tools 1040 and 1046 may pass substrates without going through the aligner 1048. In some embodiments, to ensure that a substrate is properly aligned on the hand-off tool 1046 for precision delivery to an electroplating module, the hand-off tool 1046 may align the substrate with an aligner 1048. The hand-off tool 1046 may also deliver a substrate to one of the electroplating modules 1002, 1004, or 1006, or to one of the other modules 1012, 1014, and 1016 configured for various process operations.

An example of a process operation may be as follows: (1) electrodeposit copper or another material onto a substrate (e.g., substrate 102) in the electroplating module 1004; (2) rinse and dry the substrate in SRD in the module 1012; and (3) perform edge bevel removal in the module 1014.

In addition, the electrodeposition apparatus 1000 may include the transfer station 1060 for storing the substrates 700 used for de-bubbling. After a substrate (e.g., substrate 102) is electroplated in one of the electroplating modules 1002, 1004, or 1006, before electroplating a next substrate, the hand-off tools 1040, 1046 may pick a substrate (e.g., substrate 700) from the transfer station 1060, position the substrate in the electroplating module, and perform de-bubbling as described above.

Figure 11A:
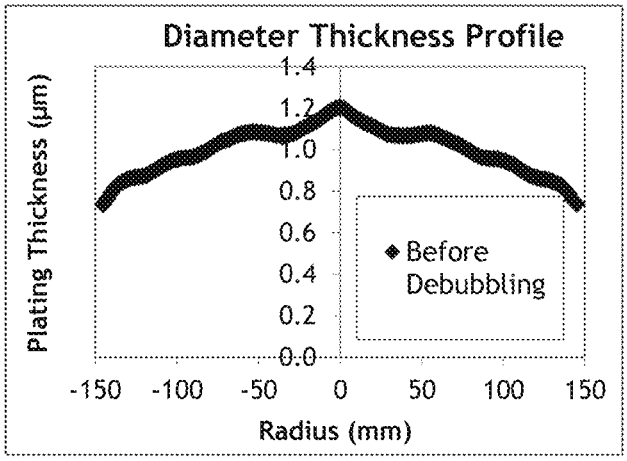
FIGS. 11A-11C show performances of manual and automatic processes used to remove the air bubbles in the electroplating cell.
Figure 11B:
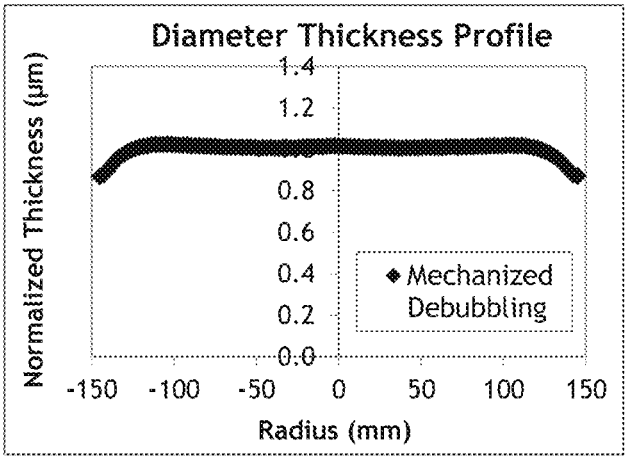
Figure 11C:
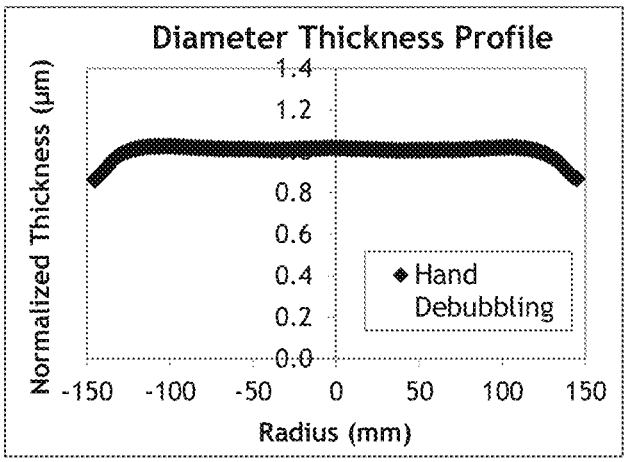

FIGS. 11A-11C show that the de-bubbling performed according to the teachings of the present disclosure using the electrodeposition apparatus 1000 is at least as effective as manual de-bubbling. In addition, the de-bubbling performed using the electrodeposition apparatus 1000 takes less time than manual de-bubbling, prevents contamination of the electrodeposition apparatus 1000, and eliminates exposure of operators to chemical that occurs during manual de-bubbling.

Figure 12:
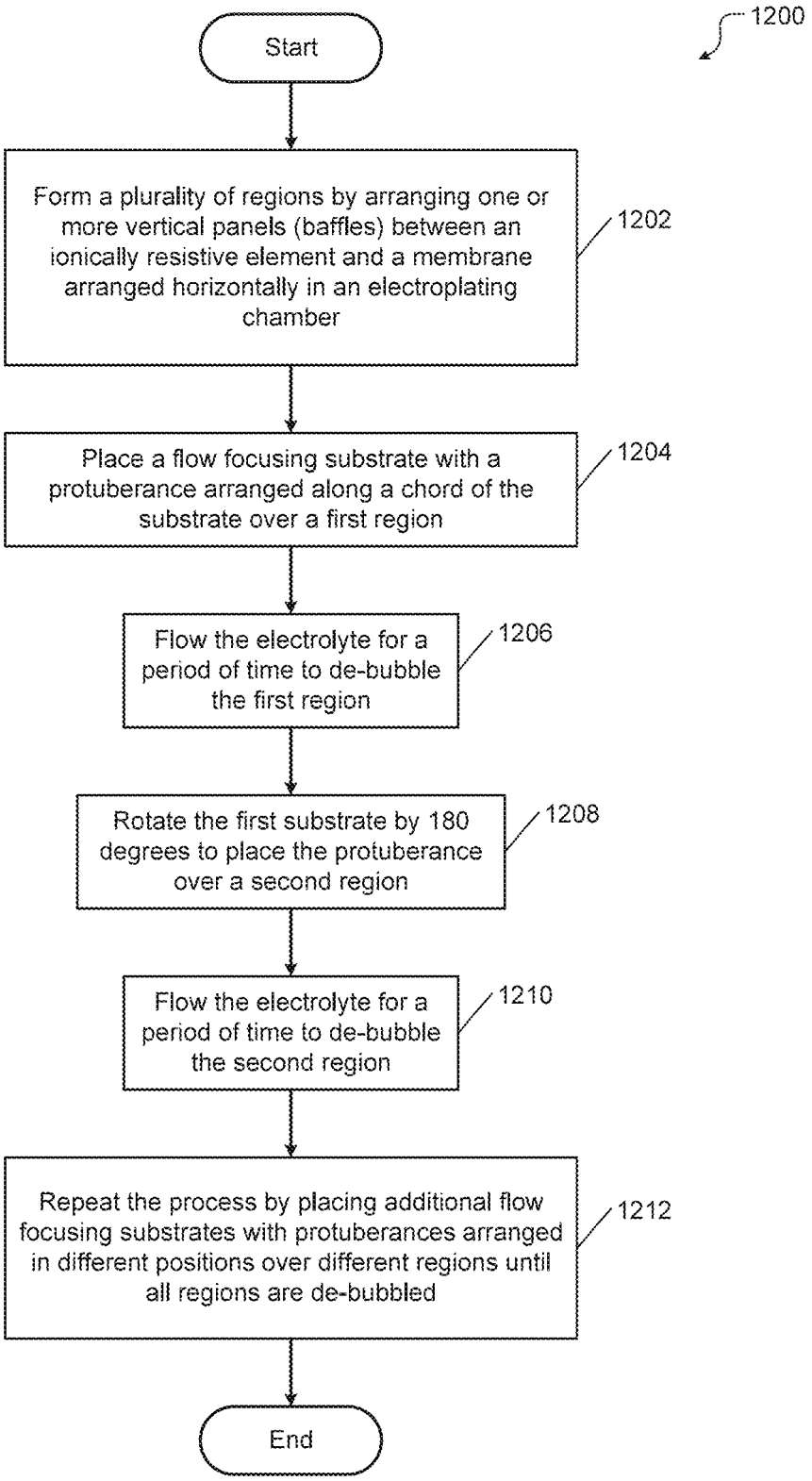
FIG. 12 shows a flowchart of a method for removing the air bubbles in the electroplating cell.

FIG. 12 shows a method 1200 for removing air bubbles in an electroplating cell (e.g., the electroplating cell 101) using various apparatuses (e.g., with various substrates 700 with various protuberances 702) described above. For example, the controller 1030 shown in FIG. 10 can perform the method 1200. The term control as used below indicates code or instructions stored in a memory and executed by a processor in the controller 1030. The method 1200 can be performed after a substrate (e.g., substrate 102) is electroplated and before another substrate is to be electroplated in the electroplating cell. The method 1200 can also be performed when a preventive maintenance is to be performed on the electroplating cell.

At 1202, one or more vertical panels (e.g., baffles 130) are arranged between an ionically resistive element (107) and a membrane (105) in the electroplating cell to form a plurality of regions (139). At 1204, control places a flow focusing substrate (e.g., 700) with a protuberance (e.g., 702) arranged along a chord of the substrate over a first region. At 1206, control flows an electrolyte for a period of time to de-bubble the first region. At 1208, control rotates the first substrate by 180 degrees to place the protuberance over a second region. At 1210, control flows the electrolyte for a period of time to de-bubble the second region. At 1212, control repeats the process by placing additional flow focusing substrates with protuberances arranged in different positions over different regions until all regions are de-bubbled.

In sum, removing the air bubbles from under the ionically resistive element 107 and from within the through holes 112 of the ionically resistive element 107 currently requires manual maintenance, where an operator pumps or aspirates the ionically resistive element 107. This manual method is not robust since the manual method relies on an operator manually inspecting the ionically resistive element 107 and the many thousand through holes 112 for bubbles. Instead, automated preventative maintenance is desirable to minimize chemical exposure of maintenance personnel.

The present disclosure provides apparatuses and methods described above to remove the air bubbles that are both robust (repeatable) and automated (personnel not exposed to chemistry). The apparatus involves one or more flow focusing substrates 700 that direct the majority of the electrolyte cross flow (10-50 l/min) through a Flow Focusing Membrane (FFM) compartment (one of the regions 139). Each of the flow focusing substrates 700 comprises an elastomer or plastic seal that is responsible for sealing against the top surface of the ionically resistive element 107. Each of the flow focusing substrates 700 effectively diverts the flow of electrolyte through the ionically resistive element 107 (upstream of the seal). Since the FFM compartment (region 139) is confined, the electrolyte flows back up through the ionically resistive element 107 (downstream of the seal), which expels any trapped bubbles.

The de-bubbling method according to the present disclosure involves (1) loading the flow focusing substrate(s) 700 into the plating holder (substrate holder 103), (2) moving the substrate holder 103 with the substrate 700 to the plating position (e.g., for 30 s), (3) lifting the substrate 700 from the plating position, rotating the substrate 700 by 180 degrees, and then moving the substrate 700 back to the plating position (e.g., for 30 s), (4) repeating steps 2-3 for 1-5 times, and (5) rinsing and drying the substrate 700.

One embodiment includes using five (5) flow focusing substrates 700 (as shown in FIG. 9B), while other embodiments include using less than five (5) flow focusing substrates 700 (as shown and described with reference to FIGS. 9C and 9D). Using fewer flow focusing substrates 700 may speed up the de-bubbling process. Additionally, using fewer substrates 700 would be advantageous when large quantities of plating cells (say 16 total cells) need to be de-bubbled simultaneously.

One embodiment includes using a gasket attached to the substrate 700. Another embodiment includes using plastic protuberances which are in close proximity (~0.1 mm) to a plane parallel to the top of the ionically resistive element 107.

One embodiment includes loading the substrates 700 from a wafer FOUP (elements 1042, 1044 shown in FIG. 10) while other embodiments include loading the substrates 700 from a wafer station (element 1060 shown in FIG. 10) residing in the electroplating tool.

One embodiment includes using a wafer as the flow focusing substrate 700 while other embodiments include using a plastic substrate and/or a coated metal substrate as the flow focusing substrate 700.

Currently, the flow of electrolyte through the ionically resistive element 107 and the second manifold 111 is insufficient for bubble removal. Therefore, any bubbles in the second manifold 111 or the through holes 112 become trapped and require an operator to de-bubble the plating cell using a manual pump. If these bubbles are not removed, a non-uniform electrodeposition may occur, which can severely impact yield.

One of the issues with manual de-bubbling is that the manual de-bubbling requires an operator to visually inspect and remove the bubbles. The ionically resistive element 107 is difficult to inspect, particularly when small bubbles trapped in the through holes 112. Therefore, the efficacy of the manual de-bubbling procedure varies significantly between operators. Often a substrate needs to be processed and measured as a test (to confirm that bubbles are expelled) before the plating cell can be deemed ready for production use. Such tests waste time and resources.

Another issue with manual de-bubbling is that the manual de-bubbling requires the operator to perform manual maintenance on the plating cell. The operator needs to follow safety procedures, which include wearing appropriate Personal Protective Equipment (PPE). It is desirable to eliminate exposing operators to chemicals. The apparatuses and methods of the present disclosure automate the de-bubbling and maintenance procedures, which eliminates exposing operators to the chemicals.

Presently, the Flow Focusing Membrane (FFM) 105 results in local electrolyte flow penetration of approximately 1 to 10 l/m through the ionically resistive element 107 during the plating operations. This helps irrigate the membrane and flush each FFM compartment (region 139). While the 1 to 10 l/m total flow penetration is sufficient for membrane irrigation purposes (i.e., prevention of CuSO4 precipitation above the membrane), this amount of flow is insufficient to remove any air bubbles trapped in the FFM compartment (region 139) and/or in the through holes 112 of the ionically resistive element 107.

The present disclosure uses a substrate or a fixture (substrate 700) that includes an elastomer and/or a protruding plastic piece (protuberance 702) that sufficiently seals against the top of the ionically resistive element 107 and directs majority of the crossflow electrolyte (10-50 l/m) through the FFM compartment (region 139). This creates a relatively high, localized flow through each FFM compartment (region 139), which helps expel any trapped air bubbles.

One embodiment includes performing de-bubbling using five (5) flow focusing substrates 700. Each substrate 700 includes a gasket 702 affixed at specific locations (see FIG. 9B). The flow focusing substrates 700 are loaded into a FOUP (elements 1042, 1044 shown in FIG. 10). A robot (elements 1040 and 1046 of FIG. 10) transfers the substrates 700 into the plating module (for de-bubbling) and then into the spin rinse dry module to rinse and dry the substrates 700. Once the flow focusing substrate 700 is placed in the plating cup (substrate holder 103), the plating cup is closed and moved to the plating position (near the top of the ionically resistive element 107). The substrate 700 remains at the plating position without rotating and is rotated by 180 degrees every 30 s, for example, so that each baffle region 139 is de-bubbled for 60 s, for example. The 180 degree rotation ensures that two (2) FFM regions 139 are de-bubbled for each flow focusing substrate 700. This sequence is repeated for each flow focusing substrate 700 until the entire ionically resistive element 107 is de-bubbled.

The results of the above automated de-bubbling procedure according to the present disclosure at least match the manual de-bubbling result (see FIGS. 11A-11C). Operators are no longer required to perform manual maintenance to remove trapped air bubbles. The automated de-bubbling method of the present disclosure is more robust than the manual method, and improves the uptime and availability of the tool.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with the system, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

What is claimed is:

1. An electroplating apparatus comprising:

an electrode arranged along a bottom of a chamber;

an ionically resistive element with through holes arranged along a top of the chamber;

a membrane arranged between the electrode and the ionically resistive element;

one or more panels forming a plurality of regions between the membrane and the ionically resistive element;

a substrate holder arranged above the ionically resistive element;

a seal arranged between peripheries of the ionically resistive element and the substrate holder; and a manifold formed between a bottom of the substrate holder and a top surface of the ionically resistive element to laterally flow an electrolyte during electroplating, portions of the electrolyte descending from the manifold into the plurality of regions and ascending from the plurality of regions into the manifold via the through holes of the ionically resistive element.

2. The electroplating apparatus of claim 1 further comprising a substrate arranged along the bottom of the substrate holder, the substrate including a protuberance extending along a chord of the substrate, the protuberance contacting the top surface of the ionically resistive element above a first region of the plurality of regions, and the protuberance arranged across the top surface of the ionically resistive element along one of the panels forming the first region.

3. The electroplating apparatus of claim 2 wherein the electrolyte descends from the manifold into the first region via the through holes on a first side of the protuberance and ascends from the first region into the manifold via the through holes on a second side of the protuberance to force air bubbles out from a portion of the ionically resistive element associated with the first region.

4. The electroplating apparatus of claim 2 wherein the protuberance is integrated into the substrate.

5. The electroplating apparatus of claim 2 wherein the protuberance is a gasket.

6. The electroplating apparatus of claim 2 wherein the protuberance is arranged at a center of the first region.

7. The electroplating apparatus of claim 2 wherein the protuberance extends linearly along the chord of the substrate.

8. The electroplating apparatus of claim 2 wherein the protuberance extends nonlinearly along the chord of the substrate.

9. The electroplating apparatus of claim 2 wherein the protuberance includes one or more gaps along a length of the protuberance.

10. The electroplating apparatus of claim 2 wherein the substrate includes a second protuberance along a second chord of the substrate, the second protuberance contacting the top surface of the ionically resistive element above a second region of the plurality of regions, and wherein the second protuberance is arranged across the top surface of the ionically resistive element along one of the panels forming the second region.

11. The electroplating apparatus of claim 10 wherein the electrolyte descends from the manifold into the second region via the through holes on a first side of the second protuberance and ascends from the second region into the manifold via the through holes on a second side of the second protuberance to force air bubbles out from a portion of the ionically resistive element associated with the second region.

12. The electroplating apparatus of claim 10 wherein the protuberance and the second protuberance are parallel to each other.

13. The electroplating apparatus of claim 10 wherein the protuberance and the second protuberance are not parallel to each other.

14. The electroplating apparatus of claim 10 wherein at least one of the protuberance and the second protuberance includes one or more gaps along respective lengths.

15. The electroplating apparatus of claim 14 wherein the gaps of the protuberance and the second protuberance are aligned with each other.

16. The electroplating apparatus of claim 14 wherein the gaps of the protuberance and the second protuberance are not aligned with each other.

17. The electroplating apparatus of claim 2 wherein the seal pushes against the substrate holder due to flow of the electrolyte in the manifold and allows the electrolyte in the manifold to force air bubbles out from under and in the through holes of the ionically resistive element.

18. The electroplating apparatus of claim 1 wherein the membrane focuses the flow of the electrolyte via the through holes.

19. The electroplating apparatus of claim 1 wherein the ionically resistive element operates as a uniform current source during electroplating.

20. The electroplating apparatus of claim 2 wherein at least a plurality of the through holes has the same dimension and density and is perpendicular relative to a plane along which the substrate lies.

21. The electroplating apparatus of claim 2 wherein at least a plurality of the through holes has different dimensions and densities and is oblique relative to a plane along which the substrate lies.

22. The electroplating apparatus of claim 2 further comprising a controller is configured to:

keep the protuberance in contact with the top surface of the ionically resistive element above the first region for a first predetermined time;

rotate the substrate after the first predetermined time and position the protuberance in contact with the top surface of the ionically resistive element above a second region of the plurality of regions along one of the panels forming the second region; and keep the protuberance in contact with the top surface of the ionically resistive element above the second region for a second predetermined time, wherein the electrolyte descends from the manifold into the second region via the through holes on a first side of the protuberance and ascends from the second region into the manifold via the through holes on a second side of the protuberance to force air bubbles out from a portion of the ionically resistive element associated with the second region.

23. The electroplating apparatus of claim 2 further comprising a controller is configured to:

place, in the substrate holder, a second substrate with a second protuberance extending along a chord of the second substrate, the second protuberance contacting the top surface of the ionically resistive element above a second region of the plurality of regions, and wherein the second protuberance is arranged across the top surface of the ionically resistive element along one of the panels forming the second region;

wherein the electrolyte descends from the manifold into the second region via the through holes on a first side of the second protuberance and ascends from the second region into the manifold via the through holes on a second side of the second protuberance to force air bubbles out from a portion of the ionically resistive element associated with the second region.

24. The electroplating apparatus of claim 23 wherein the protuberance and the second protuberance are respectively integrated into the substrate and the second substrate.

25. The electroplating apparatus of claim 23 wherein each of the protuberance and the second protuberance is a gasket.

26. The electroplating apparatus of claim 23 wherein the controller is configured to:

keep the second protuberance in contact with the top surface of the ionically resistive element above the second region for a first predetermined time;

rotate the second substrate after the first predetermined time and position the second protuberance in contact with the top surface of the ionically resistive element above a third region of the plurality of regions along one of the panels forming the third region; and keep the second protuberance in contact with the top surface of the ionically resistive element above the third region for a second predetermined time, wherein the electrolyte descends from the manifold into the third region via the through holes on the first side of the second protuberance and ascends from the third region into the manifold via the through holes on the second side of the second protuberance to force air bubbles out from a portion of the ionically resistive element associated with the third region.

27. The electroplating apparatus of claim 23 wherein at least one of the protuberance and the second protuberance is arranged at a center of the first and second regions, respectively.

28. The electroplating apparatus of claim 23 wherein at least one of the protuberance and the second protuberance extends linearly along the chord of the substrate and the second substrate, respectively.

29. The electroplating apparatus of claim 23 wherein at least one of the protuberance and the second protuberance extends nonlinearly along the chord of the substrate and the second substrate, respectively.

30. The electroplating apparatus of claim 23 wherein at least one of the protuberance and the second protuberance includes one or more gaps along respective lengths.

31. The electroplating apparatus of claim 30 wherein the gaps of the protuberance and the second protuberance are aligned with each other.

32. The electroplating apparatus of claim 30 wherein the gaps of the protuberance and the second protuberance are not aligned with each other.

33. The electroplating apparatus of claim 23 wherein the second substrate includes a third protuberance along a second chord of the second substrate, the third protuberance contacting the top surface of the ionically resistive element above a third region of the plurality of regions, and wherein the third protuberance is arranged across the top surface of the ionically resistive element along one of the panels forming the third region.

34. The electroplating apparatus of claim 33 wherein the electrolyte descends from the manifold into the third region via the through holes on a first side of the third protuberance and ascends from the third region into the manifold via the through holes on a second side of the third protuberance to force air bubbles out from a portion of the ionically resistive element associated with the third region.

35. The electroplating apparatus of claim 33 wherein at least two of the protuberance, the second protuberance, and the third protuberance are parallel to each other.

36. The electroplating apparatus of claim 33 wherein at least two of the protuberance, the second protuberance, and the third protuberance are not parallel to each other.

37. The electroplating apparatus of claim 33 wherein at least one of the protuberance, the second protuberance, and the third protuberance includes one or more gaps along respective lengths.

38. The electroplating apparatus of claim 37 wherein the gaps of at least two of the protuberance, the second protuberance, and the third protuberance are aligned with each other.

39. The electroplating apparatus of claim 37 wherein the gaps of at least two of the protuberance, the second protuberance, and the third protuberance are not aligned with each other.

* * * * *